US010959541B2

(12) United States Patent
Everett et al.

(10) Patent No.: US 10,959,541 B2
(45) Date of Patent: Mar. 30, 2021

(54) MERCHANDISE DISPLAY SYSTEM AND DISPLAY UNIT

(71) Applicant: The Marmon Group Limited, Wellingborough (GB)

(72) Inventors: Virgil Everett, Wellingborough (GB); Petr Bednar, Wellingborough (GB)

(73) Assignee: The Marmon Group Limited, Wellingborough (GB)

( * ) Notice: Subject to any disclaimer, the term of this patent is extended or adjusted under 35 U.S.C. 154(b) by 0 days.

(21) Appl. No.: 16/544,318

(22) Filed: Aug. 19, 2019

(65) Prior Publication Data

US 2020/0060435 A1 Feb. 27, 2020

(30) Foreign Application Priority Data

Aug. 22, 2018 (GB) ..... 1813688

(51) Int. Cl.
*A47F 1/12* (2006.01)
*A47F 5/00* (2006.01)

(52) U.S. Cl.
CPC ..... *A47F 1/126* (2013.01); *A47F 5/0018* (2013.01)

(58) Field of Classification Search
CPC ..... A47F 1/125; A47F 1/126; A47F 1/128; A47F 5/0018
See application file for complete search history.

(56) References Cited

U.S. PATENT DOCUMENTS 1,057,158 A * 3/1913 Lynch et al. ..... G07F 11/045 221/241
1,702,987 A * 2/1929 Wilson ..... A47F 1/125 211/59.3
1,910,046 A * 5/1933 Pascoe ..... A47F 1/12 211/59.3

(Continued)

FOREIGN PATENT DOCUMENTS

CH 363772 A * 8/1962 ..... A47F 1/126
DE 3211880 A1 * 10/1983 ..... A47F 1/125

(Continued)

OTHER PUBLICATIONS

Combined Search and Examination Report issued in corresponding GB Application No. 1813688.7, dated Feb. 21, 2019.

*Primary Examiner* — Stanton L Krycinski
(74) *Attorney, Agent, or Firm* — Andrus Intellectual Property Law, LLP

(57) ABSTRACT

A display unit for a merchandise display system, comprising: a support surface for supporting a plurality of merchandise items, the support surface defining a travel path for said plurality of merchandise items between a rear of the display unit and a front of the display unit; a pusher element disposed for movement relative to said support surface along said travel path; an actuation member coupleable to said pusher element and operative to control movement of said pusher element; a releasable coupling for coupling said pusher element to said actuation member, said releasable coupling configured to couple said pusher element to said actuation member when an actuation force is applied to said actuation member, and to uncouple said pusher element from said actuation member when said actuation force applied to said actuation member exceeds a threshold.

16 Claims, 25 Drawing Sheets

(56) References Cited

U.S. PATENT DOCUMENTS 2,079,754 A * 5/1937 Waxgiser ..... A47F 1/125 211/59.3
2,098,844 A * 11/1937 Waxgiser ..... A47B 81/007 211/59.3
2,506,369 A * 5/1950 Lever ..... G07D 11/12 221/59
2,980,259 A * 4/1961 Fowlds ..... A47F 1/10 211/59.3
3,348,732 A * 10/1967 Schwarz ..... G07F 11/38 221/123
4,042,096 A * 8/1977 Smith ..... A47F 1/126 211/85.18
4,119,208 A * 10/1978 Acker ..... B65G 1/06 211/134
5,413,229 A * 5/1995 Zuberbuhler ..... A47F 1/12 211/51
5,469,976 A * 11/1995 Burchell ..... A47F 1/125 211/184
5,613,621 A * 3/1997 Gervasi ..... A47F 1/125 221/279
5,638,963 A * 6/1997 Finnelly ..... A47F 1/125 211/59.3
6,155,438 A * 12/2000 Close ..... A47F 1/125 211/119.003
6,227,386 B1 * 5/2001 Close ..... A47F 1/125 211/59.3
6,375,015 B1 * 4/2002 Wingate ..... A47F 1/126 211/175
6,527,127 B2 * 3/2003 Dumontet ..... A47F 1/125 211/184
6,719,151 B2 * 4/2004 Close ..... A47F 1/12 211/119.003
8,066,128 B2 * 11/2011 Crawbuck ..... A47F 1/125 211/59.2
8,113,360 B2 * 2/2012 Olson ..... A47F 1/125 211/59.3
8,851,303 B2 * 10/2014 Crawbuck ..... A47F 1/126 211/59.2
9,055,828 B2 * 6/2015 Burchell ..... A47F 1/125
9,198,527 B2 * 12/2015 Goehring ..... A47F 1/12
9,265,362 B2 * 2/2016 Hardy ..... A47F 1/126
10,219,637 B2 * 3/2019 Åberg ..... A47F 1/125
2004/0178158 A1 * 9/2004 Close ..... A47F 1/12 211/59.3
2004/0245197 A1 * 12/2004 McElvaney ..... A47F 1/126 211/184
2005/0098515 A1 * 5/2005 Close ..... A47F 1/12 211/59.3
2005/0258113 A1 * 11/2005 Close ..... A47F 1/125 211/59.3
2007/0068885 A1 * 3/2007 Busto ..... A47F 1/125 211/59.3
2007/0138114 A1 * 6/2007 Dumontet ..... A47F 1/126 211/59.3
2007/0256992 A1 * 11/2007 Olson ..... A47F 5/005 211/59.3
2009/0101606 A1 4/2009 Olson
2012/0237330 A1 * 9/2012 Wensman ..... A47F 13/08 414/800
2018/0249848 A1 * 9/2018 Goehring ..... A47F 5/0025
2019/0061950 A1 * 2/2019 Hoogeveen ..... B64D 11/04

FOREIGN PATENT DOCUMENTS

DE 9210275 U1 * 10/1992 ..... A47F 1/125
EP 3081116 A1 * 10/2016 ..... A47F 5/005
WO WO 2005021406 3/2005
WO WO 2015017811 2/2015

* cited by examiner (i)

(ii)

(iii)

(iv)

MERCHANDISE DISPLAY SYSTEM AND DISPLAY UNIT

CROSS-REFERENCE TO RELATED APPLICATION

This application claims priority to GB Patent Application No. 1813688.7, filed Aug. 22, 2018, which is hereby incorporated herein by reference, in entirety.

TECHNICAL FIELD

The present invention relates to a display unit for a merchandise display system and a merchandise display system comprising said display unit. In particular, but not exclusively, the present invention relates to a display unit for facing of merchandise items and a merchandise display system comprising said display unit for facing of merchandise items.

BACKGROUND

"Facing" (also known as blocking, zoning, straightening, rumbling, or conditioning) is a common practice in the retail industry to create the look of a perfectly stocked store (even when it is not) by pulling, or moving, all of the products, or merchandise items, on a display or shelf to the front, or by filling empty space at a front of a shelf with merchandise items. It is also done to keep the store appearing neat and organized. Retailers, wholesalers and showrooms place their merchandise products on shelves in certain ways. They may arrange merchandise product packages in colourful horizontal or vertical patterns, featuring some brands more than others. For example, products on a shelf may be arranged in "columns" in which the products extend rearward from the front-most product of each column. However situated, "facing" is when merchandise items are moved to the edge of shelves with their fronts facing outward. Customers can then easily identify each brand when making their selections. Facings can apply to many different merchandise products, including cereal, canned soups, toilet paper and books.

As customers remove merchandise items from shelves, remaining items must be moved forward either by store operatives or a customer attempting to purchase the item. Also, when a front-most item is removed from a shelf, it is difficult for customers or prospective customers to see the remaining merchandise items, which may be spaced back from the front portion of the shelf. Additionally, when a front-most item is removed from a relatively high shelf, it may be difficult for customers or prospective customers to access remaining merchandise items.

Some types of merchandise display systems and units contain elements operable by a store operative to achieve facing of products, or merchandise items. In such merchandise display systems and units, facing is implemented manually (i.e. by the store operative) rather than automatically. These types of systems and units comprise a pusher assembly that is actuated by a manually operated pull element. A store operative can pull the pull element from the front of a shelf, which causes the pusher assembly to move from a rear portion of the shelf towards a front portion of the shelf. Continued pulling of the pull causes the pusher assembly to move forward to act upon a rear-most product, or merchandise item, in a column of products/merchandise items. This can move the column of products/merchandise items forwards towards a front portion of the shelf.

Some merchandise display systems and units include mechanical pushing apparatus to achieve automatic facing. In these merchandise display systems and units, the mechanical pushing apparatus pushes remaining merchandise items forward when a front-most merchandise item of a column of merchandise items is removed. In these systems and units, a mechanical pushing apparatus exerts a force on a rear-most product/merchandise item of each column of products/merchandise items all the time. When a store operative conducts a re-stocking operation and/or a customer returns a product/merchandise item to the shelf, the store operative/customer must push back against the action of the mechanical pushing apparatus. This may increase the risk of damage to product(s)/merchandise item(s).

Whilst merchandise display systems and units of the types as described above have been satisfactory and may continue to be satisfactory in certain instances, the inventors have recognised that it may be desirable to provide merchandise display systems and units that can inhibit excessive pressure being exerted on products/merchandise items in a column of products/merchandise items when being moved forward using a manually operated pull element and pusher assembly. Exertion of excessive pressure on products/merchandise items in a column of products/merchandise items when being moved forward using a manually operated pull element and pusher assembly may, potentially, lead to damage of softer products/merchandise items, or damage to softer types of packaging of such products/merchandise items. Also, the inventors have recognised that it may be desirable to provide merchandise display systems and units that can exert pressure on products/merchandise items only when a front-facing operation is being performed.

The present invention has been devised with the foregoing considerations in mind.

SUMMARY

According to an aspect of the present invention, there is provided a display unit for a merchandise display system, comprising: a support surface for supporting a plurality of merchandise items, the support surface defining a travel path for said plurality of merchandise items between a rear of the display unit and a front of the display unit; a pusher element disposed for movement relative to said support surface along said travel path; an actuation member coupleable to said pusher element and operative to control movement of said pusher element; a releasable coupling for coupling said pusher element to said actuation member, said releasable coupling configured to couple said pusher element to said actuation member when an actuation force is applied to said actuation member, and to uncouple said pusher element from said actuation member when said actuation force applied to said actuation member exceeds a threshold.

Uncoupling the actuation member from the pusher element when an actuation force applied to the actuation member exceeds a threshold may prevent, or inhibit, excessive pressure being exerted on products/merchandise items in a column of products/merchandise items when being moved forward using a manually operated pull element and pusher assembly. That is, once a column of products/merchandise items have been "front-faced" during a front-facing operation, the actuation member (e.g. pull element) is uncoupled from the pusher element (which acts upon the column of products/merchandise items from the rear) so that any further pulling of the actuation member from the front of the unit causes no further forward movement of the pusher element. Therefore, damage to products/merchandise items, or damage to packaging of products/merchandise items, caused by exertion of excessive pressure on products/merchandise items in a column of products/merchandise items during a front-facing operation may be avoided, or the likelihood of damage may be reduced.

Optionally, the releasable coupling may comprise: a first element disposed on said actuation member; and a second element disposed on said pusher element.

Optionally, the first element may comprise a first coupling element and the second element comprises a second coupling element, said first and second coupling element comprise respective complementary elements, and further wherein said actuation force may be transferred from said actuation member to said pusher element through interaction of said complementary elements.

Optionally, the first coupling element may comprise a first magnet comprising a first polarity and the second coupling element may comprise a second magnet comprising a second, opposite, polarity to effect coupling between said first and second elements.

Optionally, the threshold may comprise a force required to overcome a force of magnetic attraction between said first and second magnets.

Optionally, the first coupling element may comprise a first formation and said second coupling element may comprise a second formation, said first formation configured to frictionally engage said second formation to effect coupling between said first and second elements.

Optionally, the second element may comprise a biasing member to urge said second coupling element to a position where said second formation of said second coupling element is located for frictional engagement with said first formation.

Optionally, the threshold may comprise a force required to overcome a force exerted by said biasing member to move said second formation from said position.

Optionally, the releasable coupling may comprise a pusher unit coupled to said actuation member, said pusher unit comprising a housing at least a portion of which is configured to abut at least a portion of said pusher element, and further wherein said actuation force is transferred from said actuation member to said pusher element through interaction of said pusher unit and said pusher element.

Optionally, the pusher unit may comprise a flexible linkage for coupling said pusher unit to said actuation member.

Optionally, the pusher unit may further comprise: a storage element, from which said flexible linkage can be deployed; a biasing element configured to act on said storage element to urge said flexible linkage to a stowed state in said storage element.

Optionally, the actuation member may be coupled to said pusher element, and a force applied to said actuation member may be transferred to said pusher element, when said flexible linkage is in said stowed state.

Optionally, the actuation member may be uncoupled from said pusher element when said flexible linkage is in a deployed state.

Optionally, the flexible linkage may be deployable when said force applied to said actuation member exceeds a force applied by said biasing element to said storage element to urge said flexible linkage to said stowed state.

Optionally, the display unit may further comprise a biasing element coupled to the first element, and configured to urge the first element towards a rear of said display unit.

Optionally, the display unit may further comprise a biasing element coupled to the pusher unit, and configured to urge the pusher unit towards a rear of said display unit.

According to another aspect of the present invention, there is provided a merchandise display system, comprising: a shelving array comprising a plurality of shelves; at least one display unit, as described above and hereinafter, located on at least one of said plurality of shelves.

Optionally, the support surface may comprise a shelf surface.

Optionally, the system may comprise a plurality of said display units, and the system further may comprise a connecting element connected to the actuation member of each display unit of said plurality of units.

BRIEF DESCRIPTION OF THE DRAWINGS

One or more embodiments of the present invention are described further hereinafter, by way of example only, with reference to the accompanying drawings in which.

DETAILED DESCRIPTION OF THE INVENTION

The merchandise display system and unit according to one or more embodiments of the present invention employs "dividers" to maintain separate rows, or columns, of merchandise items, or products, and allows merchandise items to be moved to the front edge of shelves and/or to a stock limiter located at, or proximate, a front edge of a shelf. One or more units may be located on an upper surface of one or more shelves of a shelving array to form a merchandise display system. Also, the units may be discrete, so that they may be removable from a shelf, or they may be integrated with a shelf.

Figure 1:
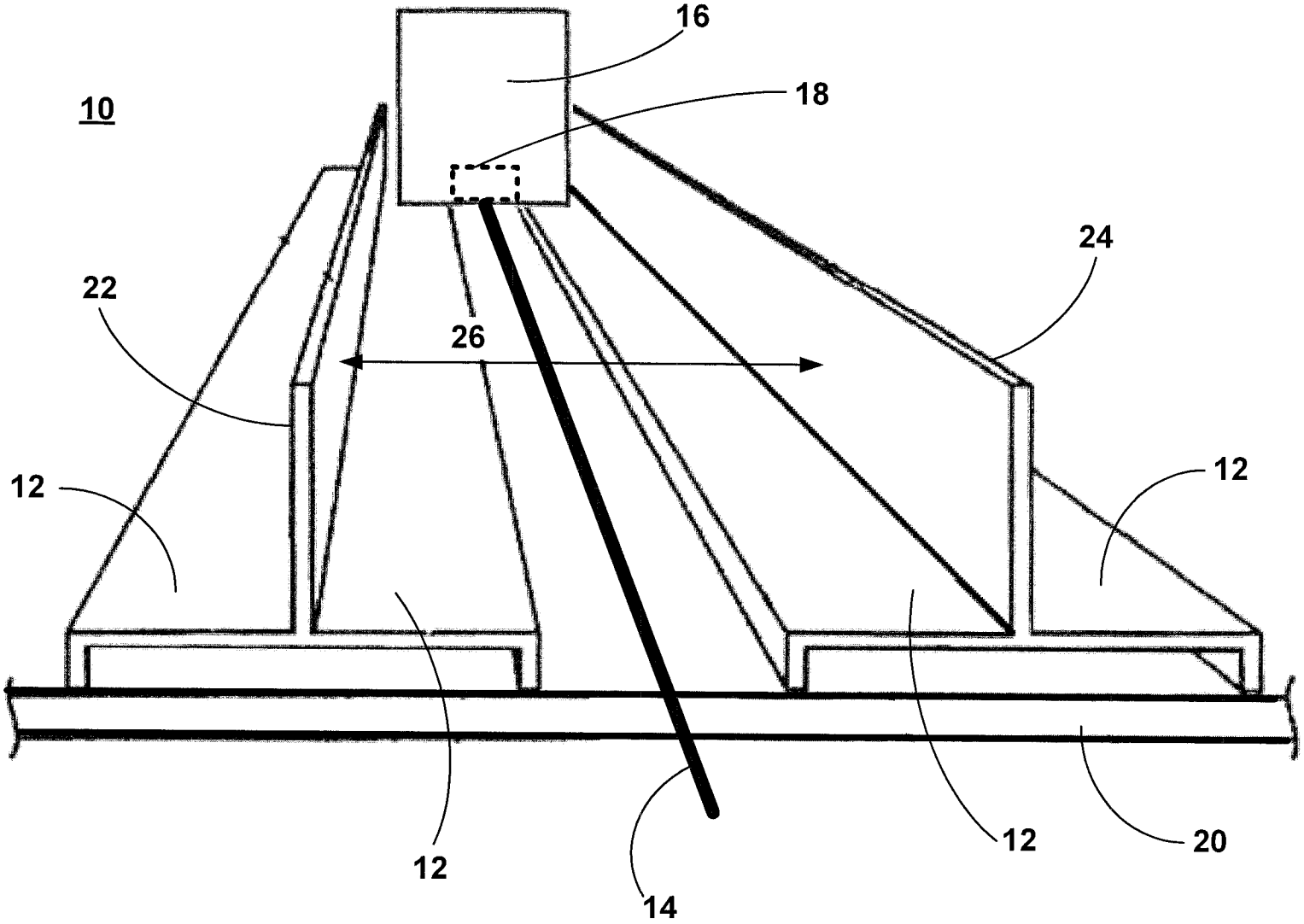
FIG. 1 illustrates a perspective end view of a merchandise display unit according to one or more embodiments of the present invention.

FIG. 1 illustrates a merchandise display unit 10 according to one or more embodiments of the present invention. The merchandise display unit 10 comprises a support surface, which comprises an elongate planar element upon which at least one merchandise item can be supported. The length of the support surface 12 is such that a plurality of merchandise items can be located adjacent one another in a "column" over the length of the support surface 12. The unit 10 further comprises an actuation member, in the form of a pull element 14 in the illustrated example. The pull element 14 is coupleable to a pusher element 16 by releasable coupling 18 of which at least a part is mounted on, attached to, and/or coupled to the pull element 14.

In the one or more embodiments herein described (and illustrated) the pull element 14 comprises a flexible linkage. In an example, the flexible linkage comprises nylon.

Figure 2:
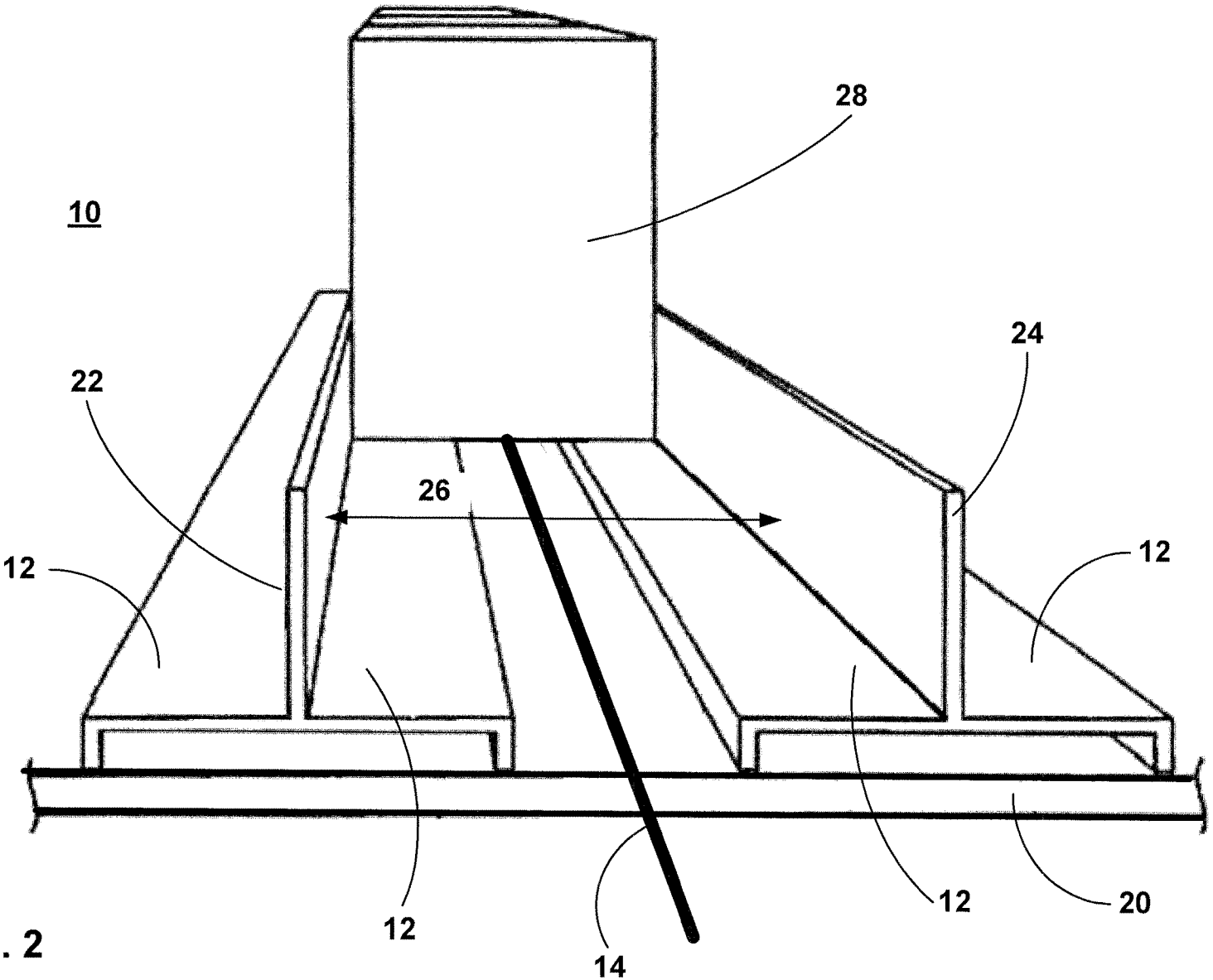
FIG. 2 illustrates a the merchandise display unit of FIG. 1 containing merchandise items.

FIG. 1 illustrates the merchandise display unit 10 disposed on a shelf 20. The unit 10 also comprises a first lateral wall 22 that upstands from a first side edge of the support surface 12 and a second lateral wall 24 that upstands from a second side edge of the support surface 12. The first and second lateral walls 22, 24 serve to prevent sideways movement of merchandise items out of the "column" of merchandise items. The first and second lateral walls 22, 24 define therebetween a channel 26 for receiving and supporting merchandise items, and for holding the merchandise items in the "column" in an ordered arrangement. The channel 26 defines a travel path for merchandise items located in the channel 26. A column of merchandise items 28 located in the channel 26 is shown in FIG. 2.

The unit 10 may be attached to the shelf 20 by permanent means, temporary means, or may rest on the shelf 20. For example, attachment may be by fixings, such as screws, or by adhesive, or by magnetic fixings. In the example of magnetic fixings, the unit 10 can be maintained in a predetermined position on shelf 20 by magnetic strips affixed under the unit 10. The magnetic strip may be bonded, screwed to or attached by any suitable means to the unit 10. Using magnetic material, or indeed other types of temporary fixing elements, as means to attach the unit 10 to the shelf 20 may provide flexibility to adjust the position of the unit 10 on the shelf 20, e.g. to accommodate greater, or fewer, units 10 in a merchandise display system.

The pull element 14 is able to move forwards and backwards under the column of merchandise items allowing the pusher element 16 to press against a rearmost merchandise item.

The pusher element 16 comprises at least one magnet on an underside to couple the pusher element 16 to support surface 12. The at least one magnet may assist in maintaining the pusher element 16 in an upright orientation, i.e. prevent tipping of the pusher element 16 when it slideably traverses the support surface 12 (e.g. under influence of a pulling force exerted thereon by way of pull element 14).

Figure 3:
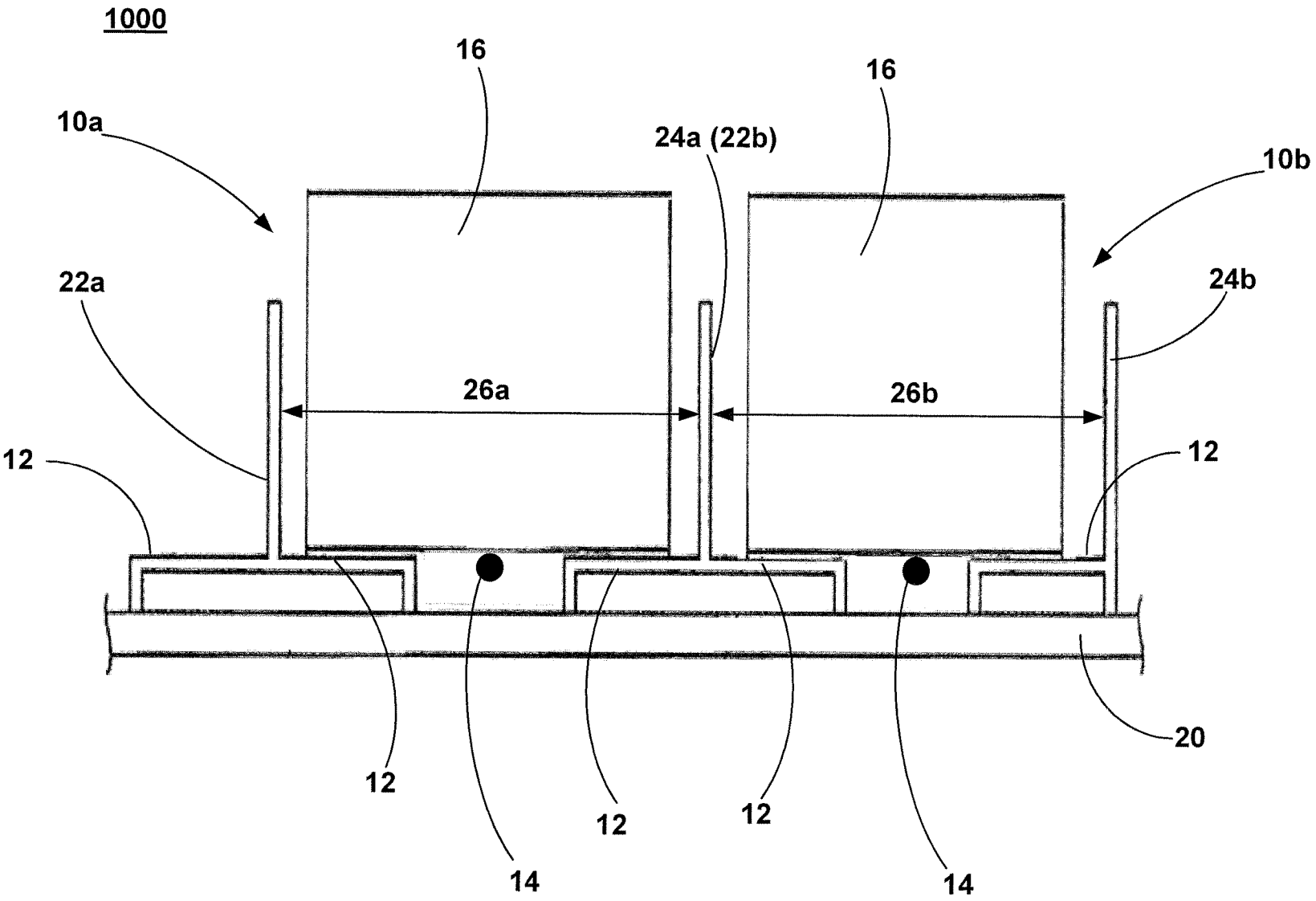
FIG. 3 illustrates an end view of a merchandise display system comprising two merchandise display units.

FIG. 3 shows an end view of a merchandise display system 1000 comprising two merchandise display units 10*a*, 10*b*, which comprise respective merchandise item channels 26*a*, 26*b*. First merchandise display unit 10*a* comprises first lateral wall 22*a* and second lateral wall 24*a*. Second merchandise display unit 10*b* comprises first lateral wall 22*b* and second lateral wall 24*b*. In the illustrated example, there is a common, shared wall between the first and second merchandise display units 10*a*, 10*b*, i.e. the second lateral wall 24*a* of the first merchandise display unit 10*a* is the same as the first lateral wall 22*b* of the second merchandise display unit 10*b*. This shared wall keeps the two columns of merchandise items separated.

Figure 4:
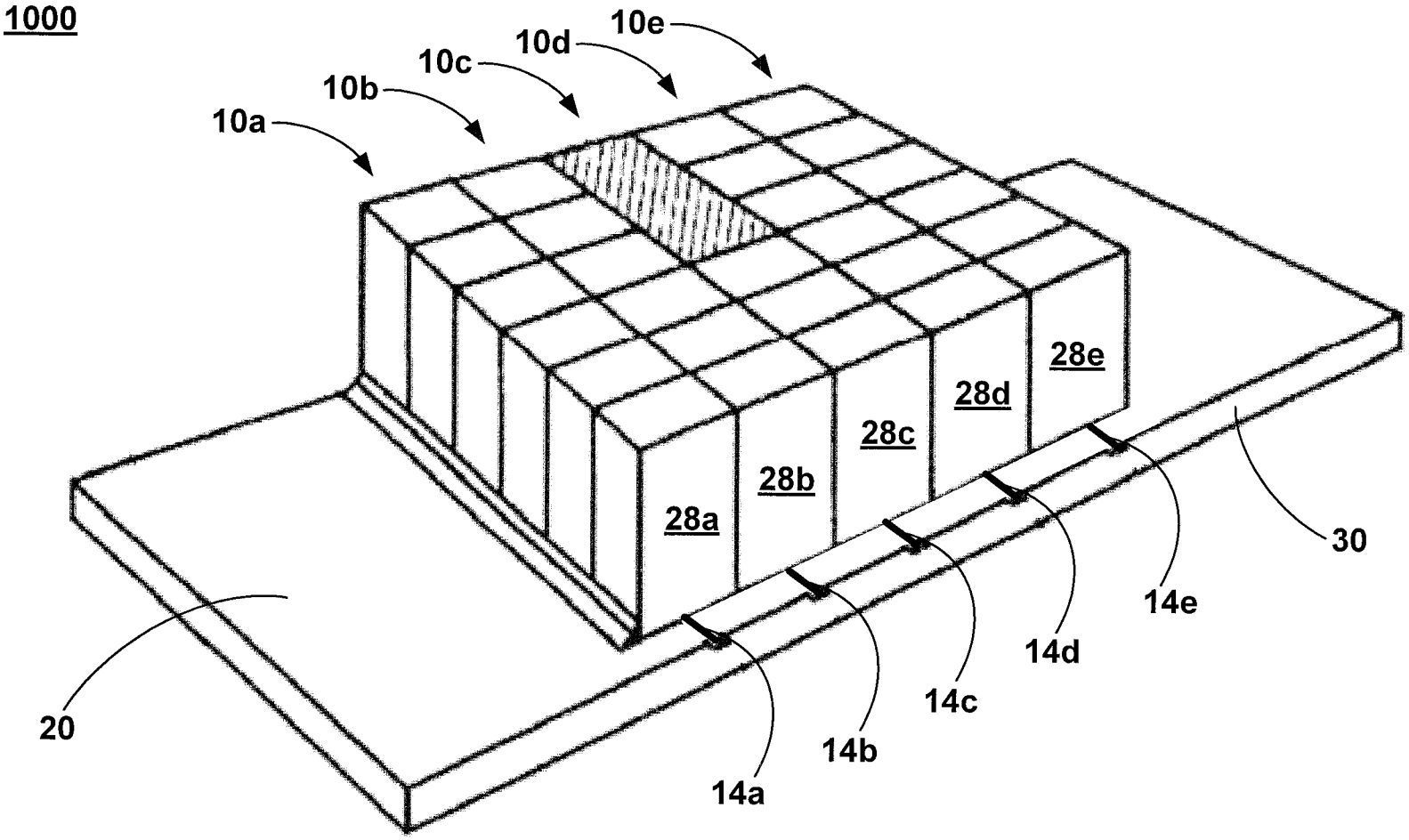
FIGS. 4 to 7 illustrate a perspective side view of a merchandise display system comprising a plurality of merchandise display units containing merchandise items.

FIGS. 4 to 7 illustrate a merchandise display system 1000 comprising five merchandise display units 10*a* to 10*e*, and these figures show how the merchandise display units may be used. In FIG. 4, merchandise display system 1000 comprises shelf 20, which has disposed thereon five merchandise display units 10*a* to 10*e*. There are five columns of merchandise items 28*a* to 28*e* contained in the five merchandise display units, i.e. one column of merchandise items per merchandise display unit. Each merchandise display unit comprises a pull element 14*a* to 14*e*, which is disposed under each row of merchandise items 28. Each pull element 14*a* to 14*e* is coupleable to a pusher element, as seen in FIG. 1, positioned behind a column of merchandise items to engage the rearmost merchandise item of each column when the respective pull element 14*a* to 14*e* is pulled away from the display shelf front edge 30. The merchandise display units 10*a* to 10*e* keep the merchandise items from contacting the shelf 20 and allow respective pull elements 14*a* to 14*e* thereof to move between an underside of a column of merchandise items and the shelf 20. However, in an "integrated" arrangement, i.e. where the support surface comprises an upper surface of a shelf, the merchandise items are in direct contact with the upper surface of the shelf and the pull elements pass between an underside of each merchandise item and the upper surface of the shelf.

Figure 5:
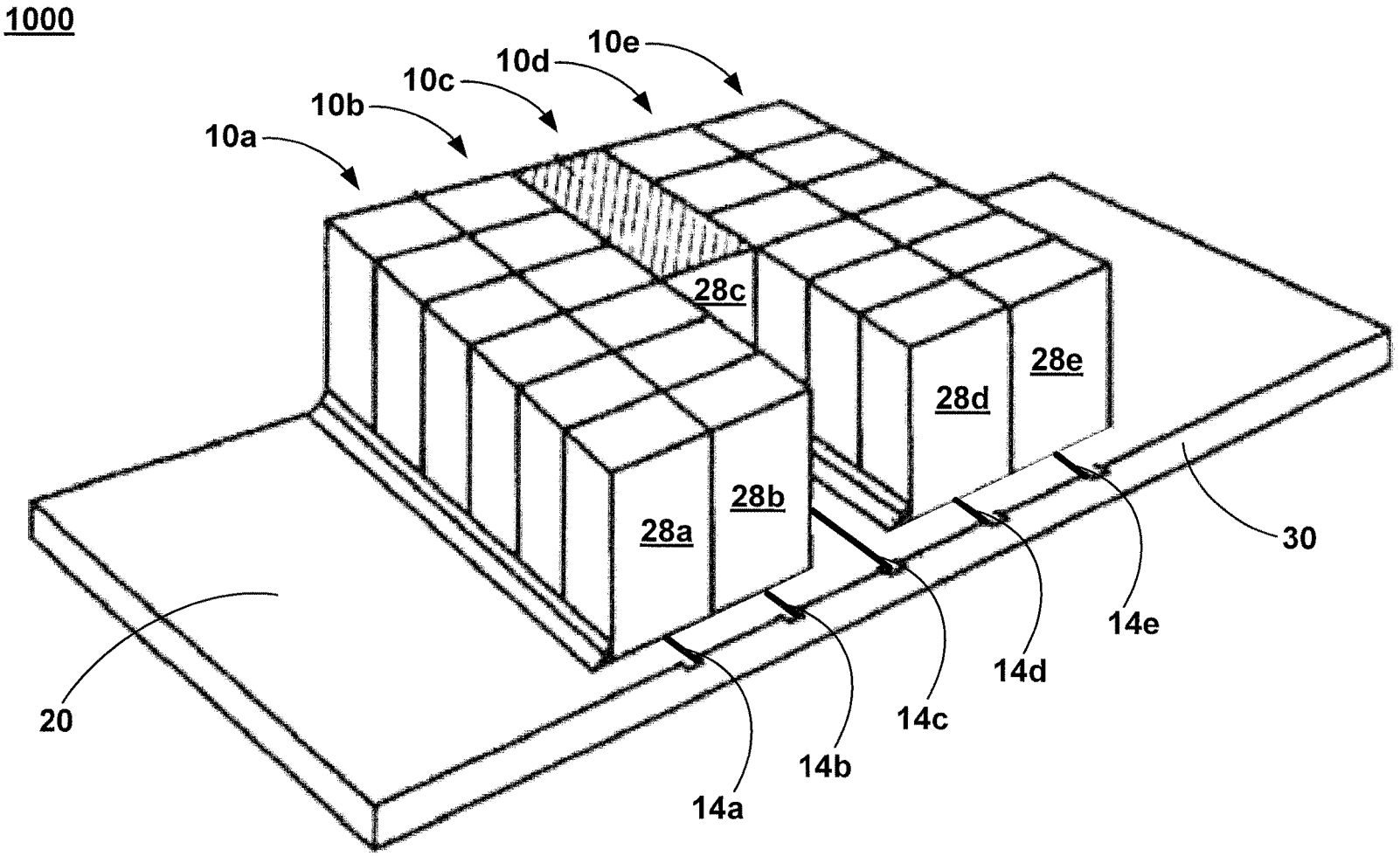
Figure 6:
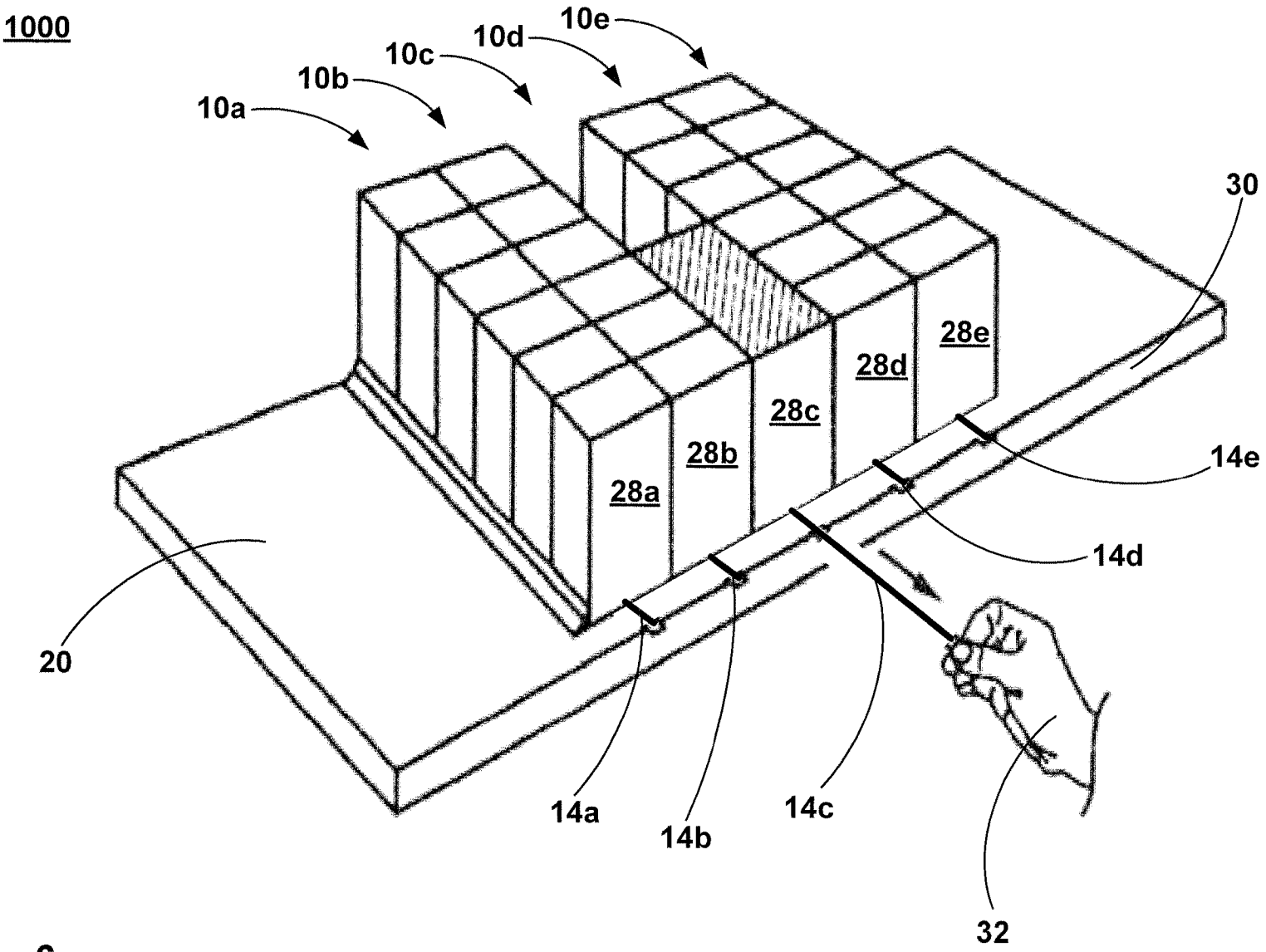
Figure 7:
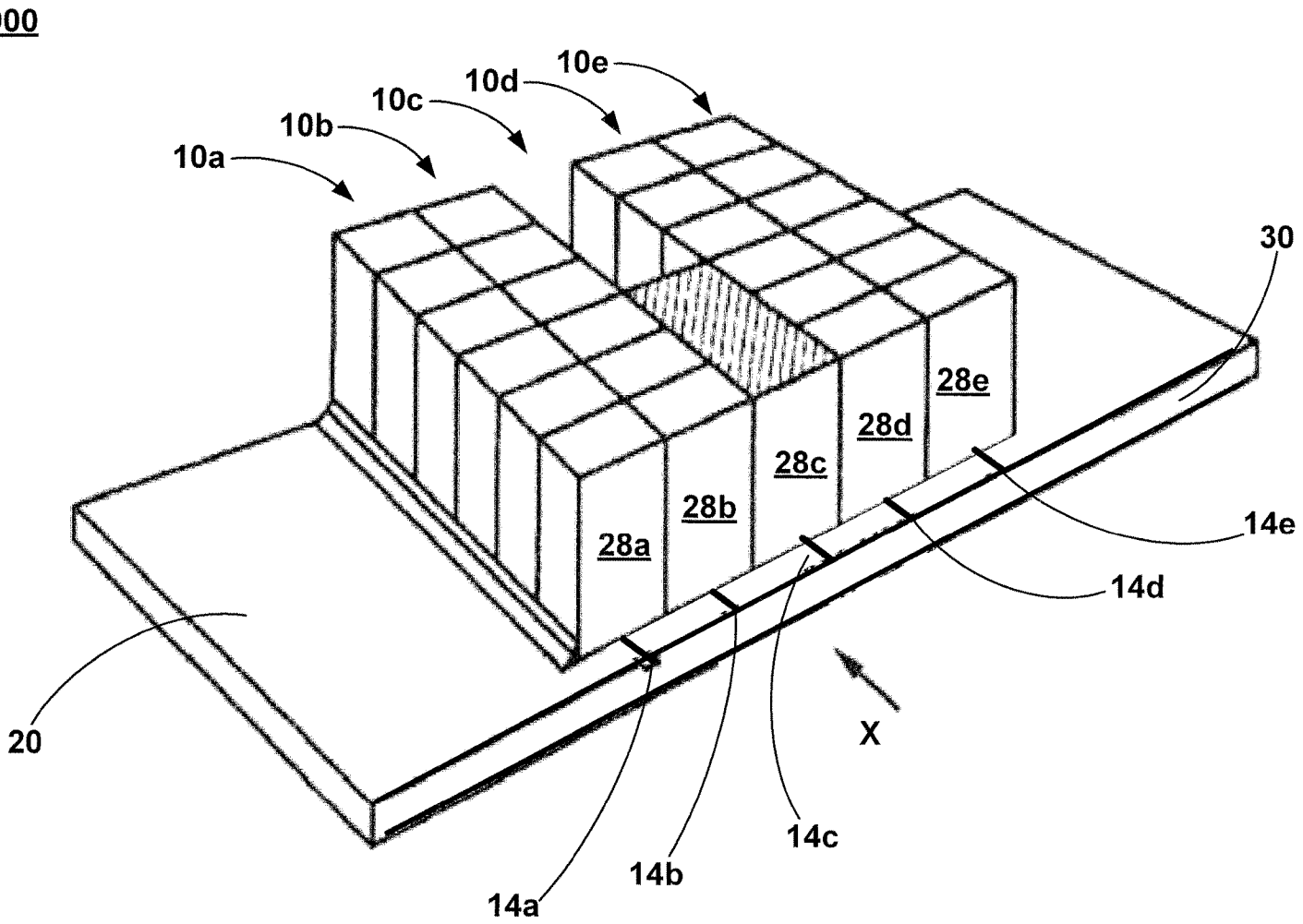

FIGS. 5, 6 and 7 show how merchandise items that are located in the back of a channel can be brought forward towards the front of the channel without having to move each individual merchandise item separately. The first three merchandise items 28*c* of third merchandise display unit 10*c* in FIG. 5 have been removed from the shelf 20. To move the remaining three merchandise items 28*c* closer to the front edge 30 of shelf 20, a store operative 32 operates the pull element 14*c* of third merchandise display unit 10*c* by pulling it away from the shelf front edge 30 (see FIG. 6). The pusher element of the pull element 14*c* engages the back of the rearmost merchandise item in the column of items in third merchandise display unit 10*c* and causes the merchandise items in this column to move towards the display shelf front edge 30 of shelf unit 20 until their position conforms with the location of the other merchandise items 28*a*, 28*b*, 28*d*, 28*e* in the other columns of merchandise items. In FIG. 7, the pull element 14*c* of third merchandise display unit 10*c* is returned to its original position by the store operative releasing the pull element 14*c* and by way of a biasing element (not shown) coupled between the pull element 14*c* and a fixing at the rear of the shelf. The biasing element operates to pull the pull element 14*c* in a direction towards the rear of the shelf. This effectively "retracts" the pull element 14*c* in a direction indicated by arrow X in FIG. 7.

Figure 8:
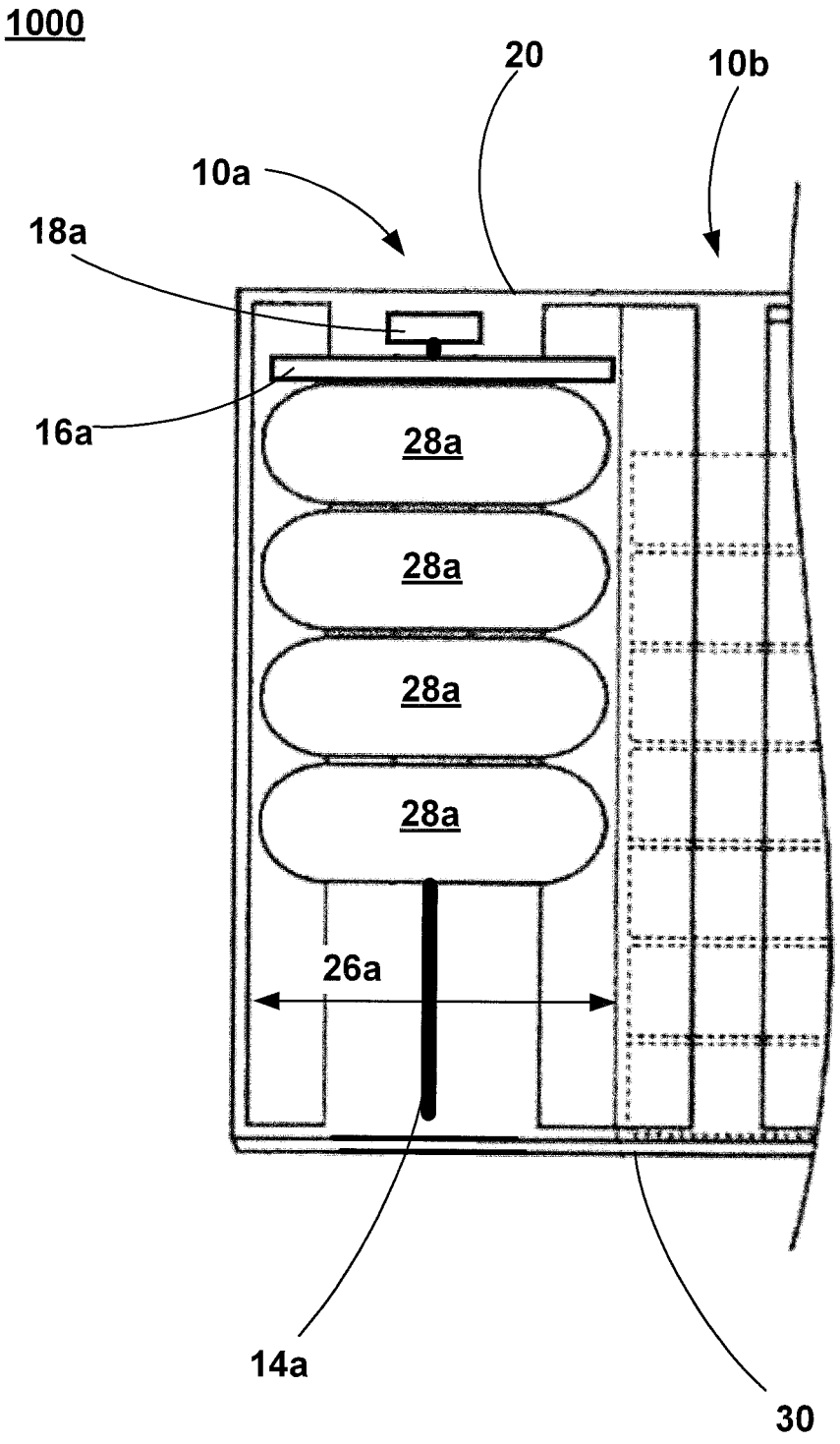
FIGS. 8 and 9 illustrate a top plan view of a merchandise display unit of a part of a merchandise display system.

FIG. 8 shows a top plan view of part of the merchandise display system 1000 comprising shelf 20 with merchandise items 28*a* located in the channel 26*a* of merchandise display unit 10*a*. In the illustrated example, two merchandise items have been removed from the front of the channel 26*a*, leaving four merchandise items 28*a* in the channel 26*a*. However, these merchandise items 28*a* are not located towards the front edge 30 of shelf 20.

Figure 9:
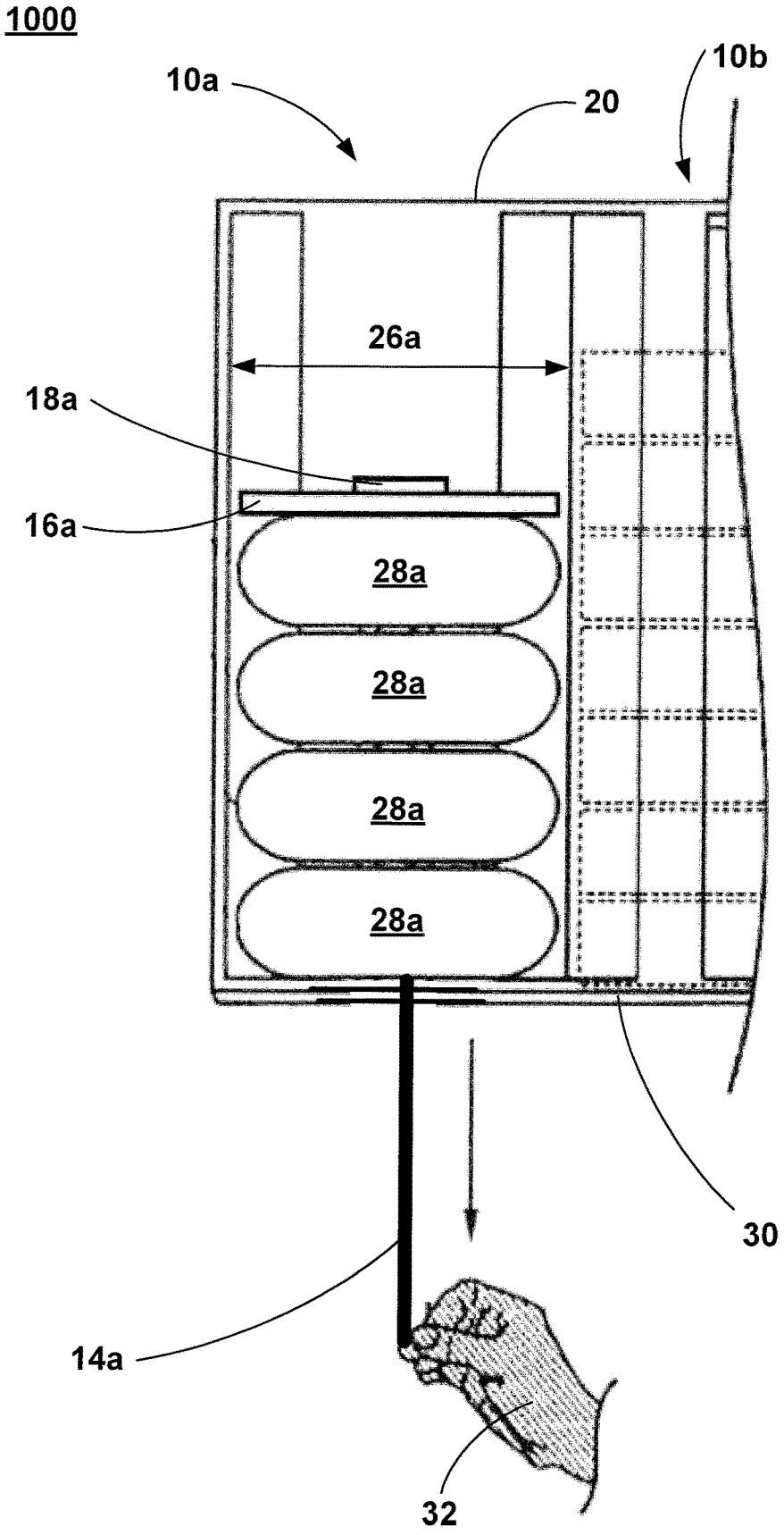

In FIG. 9, a store operative 32 has activated the pull element 14*a* by pulling it away from the front edge 30 of shelf 20. When the pull element 14*a* is pulled out from the front of the shelf (i.e. in the direction of the arrow), the releasable coupling 18*a* is moved forward from an uncoupled position (see FIG. 8) to a position where it couples with the pusher element 16*a*. In embodiments where a first part (not shown) of the releasable coupling 18*a* is coupled to pull element 14*a* and a second part (not shown) is coupled to pusher element 16*a*, a first part of releasable coupling is moved forward from an uncoupled position to a position where it couples with the second part, i.e. when the pull element 14*a* is pulled out from the front of the shelf. Forward movement of the pusher element 16*a* is achieved by further pulling of the pull element 14*a*, which causes forward movement of the pusher element 16*a* via the releasable coupling 18*a*. Pulling the pull element 14*a* in this manner causes the pusher element 16*a* to push on the rearmost merchandise item 28*a* and advance the merchandise items 28*a* towards the front edge 30 of the shelf 20.

When a merchandise item at the front of the column of merchandise items 28*a* has reached the front edge 30 of the shelf 20, the merchandise items 28*a* will be in a packed state in the column. This is because a stock-limiter (not shown) at the front of the shelf 20 prevents further forward movement of the column of merchandise items 28*a* and rearward movement is prevented by the pusher element 16*a*, which presses against the rearmost one of the merchandise items 28*a* in the column. The pusher element 16*a* is held in position through interaction of the at least one magnet, on the underside thereof, with the support surface 12, or surface of shelf.

Further pressure exerted by the pusher element 16*a* on the rearmost merchandise item 28*a* (caused by further pulling of the pull element 14*a*) is undesirable, because this may damage the merchandise items 28*a* through compression, or over-compression. Thus, the releasable coupling 18*a* is configured to uncouple the pusher element 16*a* from the pull element 14*a* when the force exerted to continue forward movement of the pull element 14*a* reaches a threshold. When this threshold is reached, the releasable coupling 18*a* uncouples the pusher element 16*a* from the pull element 14*a*, at which point the pull element 14*a* can still be pulled further from the front edge 30 of the shelf 20, but the pusher element 16*a* (being now uncoupled from the pull element 14*a*) will not advance any further.

Figure 10B:
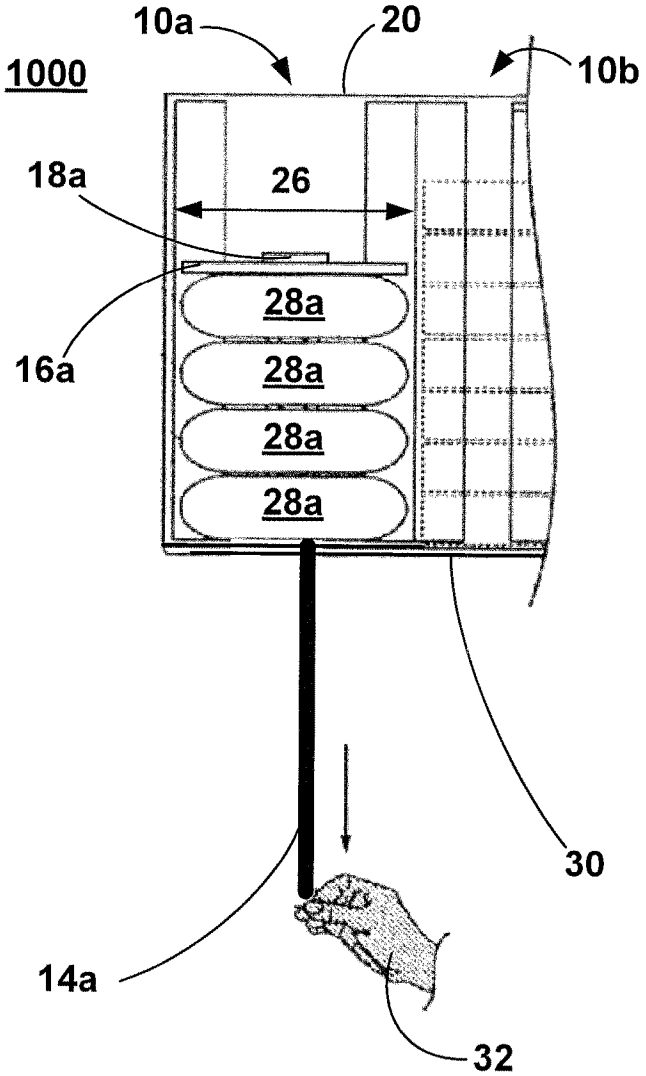
FIG. 10*b* illustrates a method of operating the merchandise display unit of FIGS. 8 and 9 in accordance with a third embodiment of the present invention.
Figure 10A:
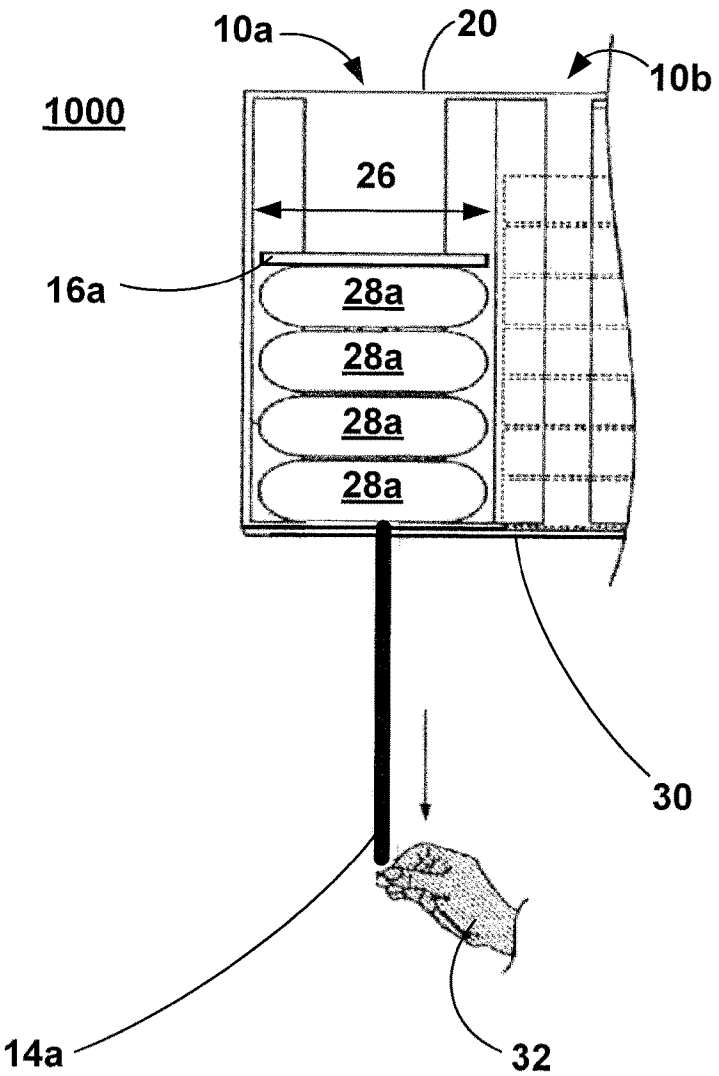
FIG. 10*a* illustrates a method of operating the merchandise display unit of FIGS. 8 and 9 in accordance with a first and second embodiment of the present invention.

FIG. 10*a* illustrates merchandise display unit 10*a* of merchandise display system 1000 where store operative 32 continues to pull the pull element 14*a* away from the front edge 30 of shelf 20 in first and second embodiments of the present invention. In these embodiments, a first part of releasable coupling, located on the pull element, continues a forward movement with continued forward movement of the pull element, and thus passes under the column of merchandise items. The first embodiment is described in more detail below in relation to FIGS. 12*a*, 12*b*, 13*a*, 13*b*, 14*a*, 14*b* and 15*a* to 15*e*. The second embodiment is described in more detail below in relation to FIGS. 16*a*, 16*b*, 17*a*, 17*b*, 18*a*, 18*b* and 19*a* to 19*d*.

FIG. 10*b* illustrates merchandise display unit 10*a* of merchandise display system 1000 where store operative 32 continues to pull the pull element 14*a* away from the front edge of the shelf 20 in a third embodiment of the present invention. In this embodiment, forward movement of the releasable coupling 18*a* does not continue with continued forward movement of the pull element 14*a*. The releasable coupling 18*a* remains in a position behind the pusher element 16, but deploys a flexible linkage, which is coupled to the pull element 14*a*. This allows the releasable coupling 18*a* to remain stationary while the pull element 14*a* can continue forward movement. This embodiment is described in more details below in relation to FIGS. 20*a*, 20*b*, 21*a*, 21*b*, 22*a* and 22*b*.

Figure 11:
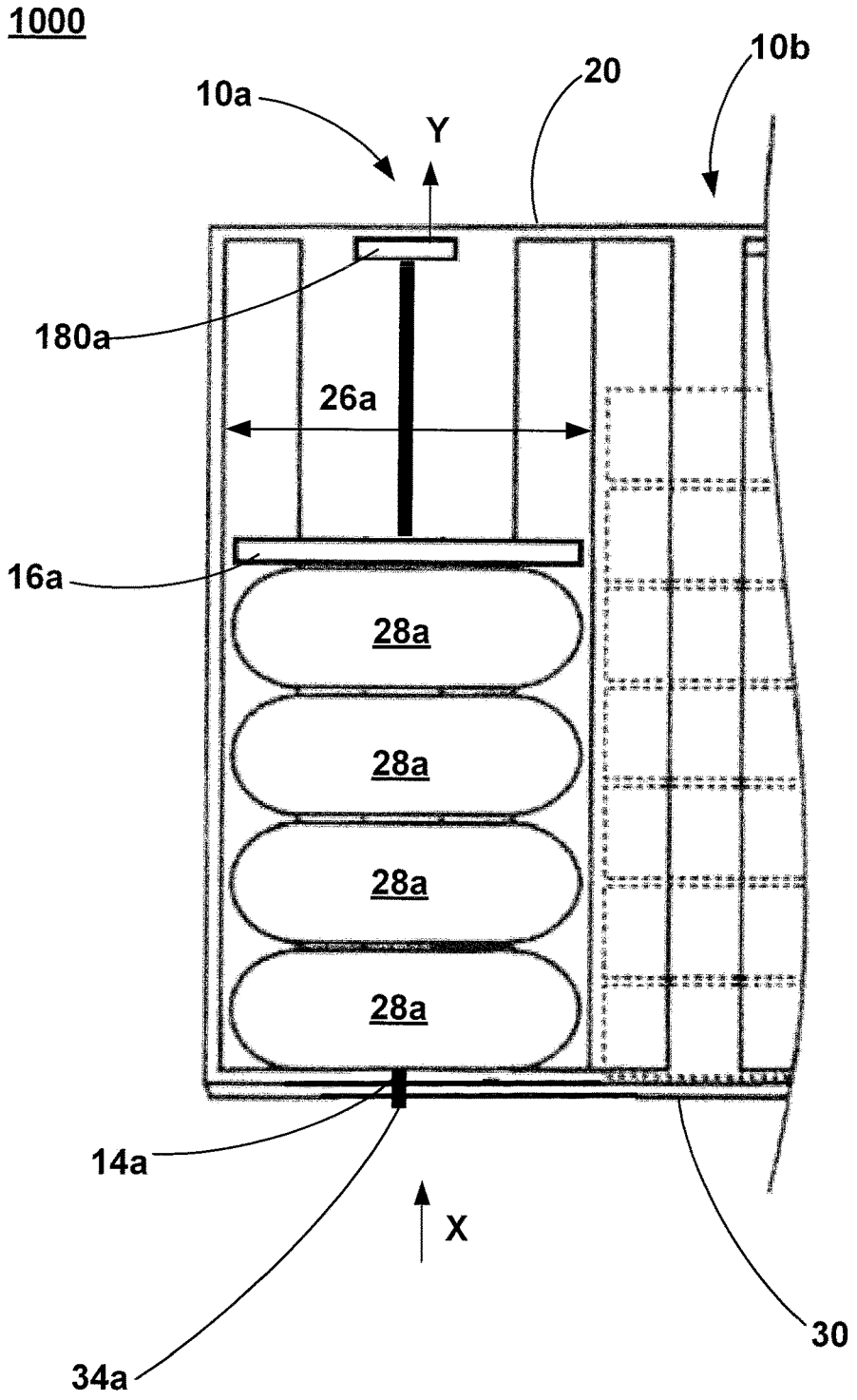
FIG. 11 illustrates the merchandise display unit of FIGS. 8 and 9 with a front-faced column of merchandise items.

Referring to FIG. 11, once the merchandise items 28*a* are reorganized, the store operative can allow the pull element 14*a* to return to its original position by releasing the pull element 14*a* from their grasp. This causes the pull element 14*a* to "retract" so that a tip 34*a* of the pull element 14*a* is once again flush with the front edge 30 of shelf 20. The "retraction" is effected by a biasing element (not shown), which is coupled to the coupling element and which acts to pull the coupling element in a direction towards the rear of the unit/shelf (i.e. in a direction indicated by arrow Y).

In the first and second embodiments, the releasable coupling comprises two elements. One of the elements is coupled to the pull element 14, and the other of the elements is coupled to the pusher element 16. The releasable coupling of the first embodiment will be described further below in relation to FIGS. 12*a*, 12*b*, 13*a*, 13*b*, 14*a*, 14*b* and 15*a* to 15*e*. The releasable coupling of the second embodiment will be described further below in relation to FIGS. 16*a*, 16*b*, 17*a*, 17*b*, 18*a*, 18*b* and 19*a* to 19*d*.

In relation to the first embodiment, first element of the releasable coupling comprises a shuttle 180 coupled to the pull element 14. The second element of the releasable coupling comprises a frame 182 mounted on the pusher element 16. Shuttle 180 is also coupled to an end of a biasing element 184. An opposite end of the biasing element 184 is coupled to a rear "R" of the unit/shelf., The biasing element 184 is configured to urge the shuttle 180 towards the rear "R" of the unit/shelf.

Figure 12B:
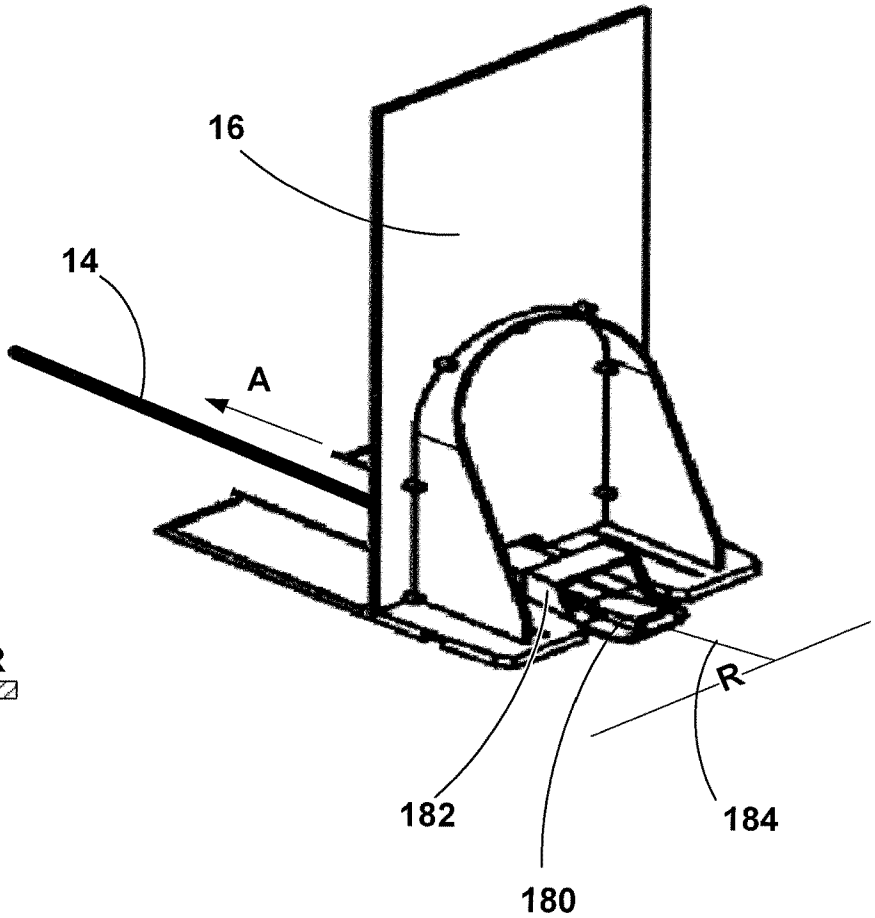
FIGS. 12*a* and 12*b* illustrate a pusher element and releasable coupling of a merchandise display unit according to a first embodiment of the present invention, with the pusher element in a first position.
Figure 12A:
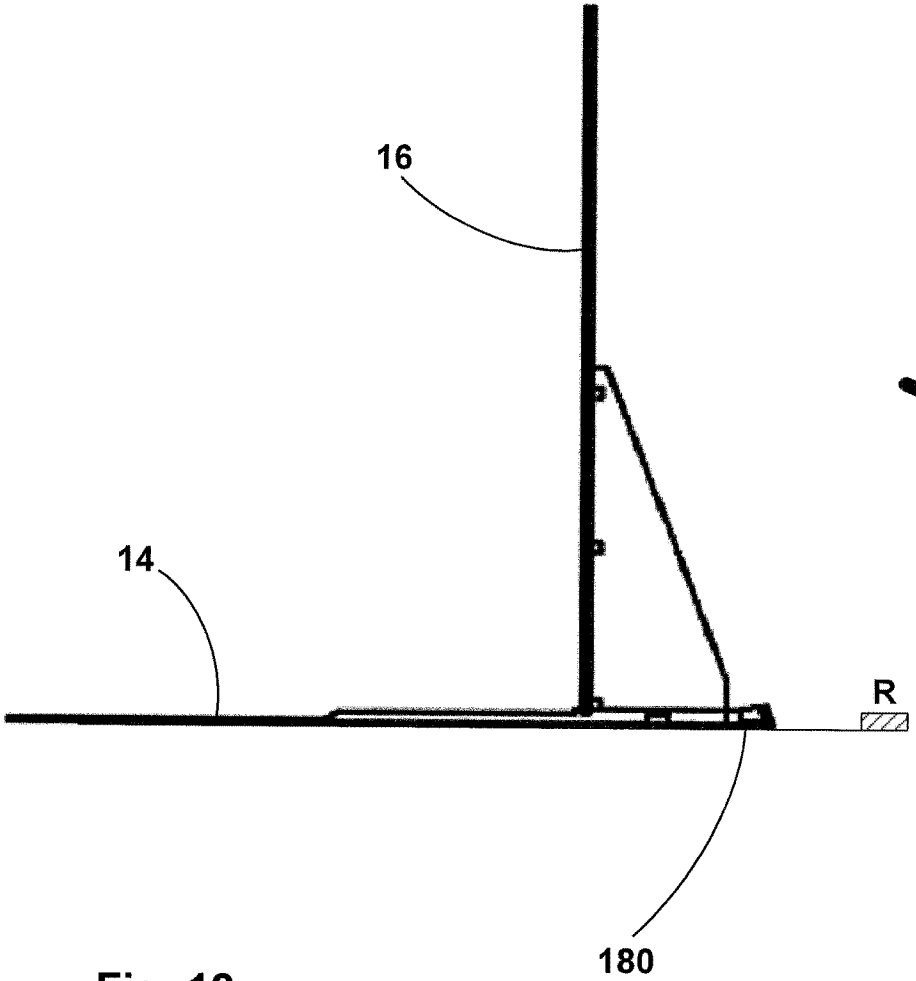

FIGS. 12*a* and 12*b* show a side view (FIG. 12*a*) and a perspective rear view (FIG. 12*b*) of the releasable coupling in a state prior to coupling of the pull element 14 to the pusher element 16.

When a store operative pulls the pull element 14 from the front of the merchandise display unit, this causes shuttle 180, which is coupled to a trailing end of the pull element 14, to move forwards from an initial location at a rear of the merchandise display unit. Continued pulling of the pull element 14 in a direction indicated by arrow A in FIG. 12*b* brings the shuttle 180 to a position behind the pusher element 16. FIGS. 12*a* and 12*b* show the shuttle 180 as it is about to enter frame 182 (i.e. pre-coupling). See FIG. 15*a*, which is described in more detail below.

Pulling the pull element 14 yet further in the direction indicated by arrow A causes the shuttle 180 to engage with the frame 182 (i.e. couple to the frame), and thus couple the pull element 14 to the pusher element 16. The releasable coupling in a "coupled" state, i.e. where it couples the pull element 14 to the pusher element 16 is illustrated in FIG. 13*a* (side view) and FIG. 13*b* (perspective rear view). See also FIG. 15*c*, which is described in more detail below.

Figure 13B:
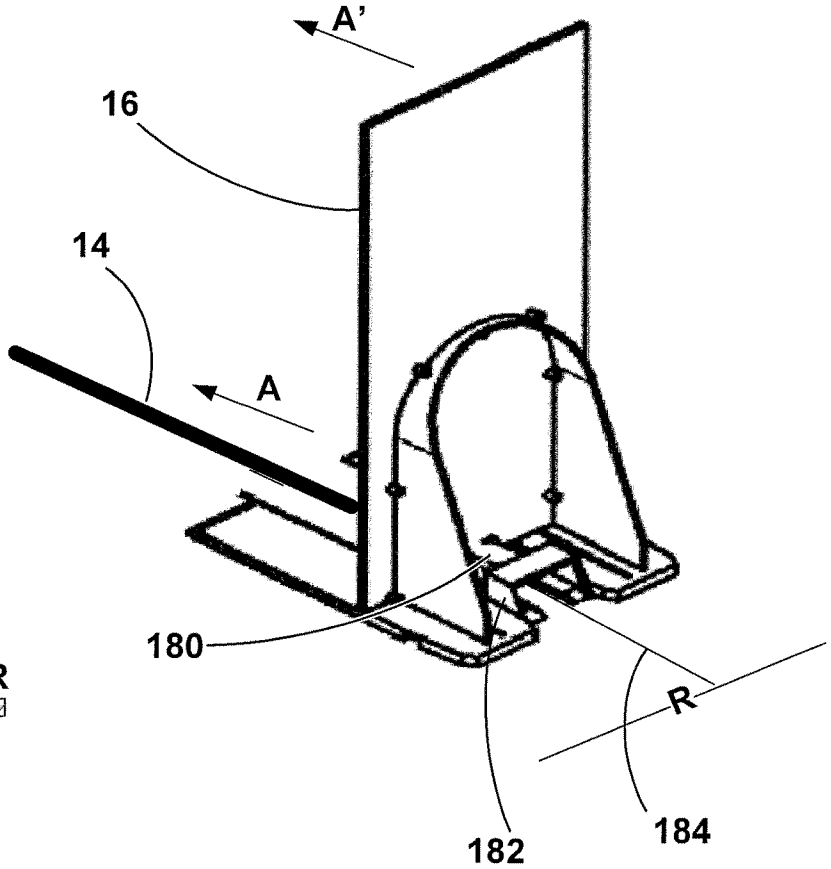
FIGS. 13*a* and 13*b* illustrate a pusher element and releasable coupling of a merchandise display unit according to a first embodiment of the present invention, with the pusher element in a second position.
Figure 13A:
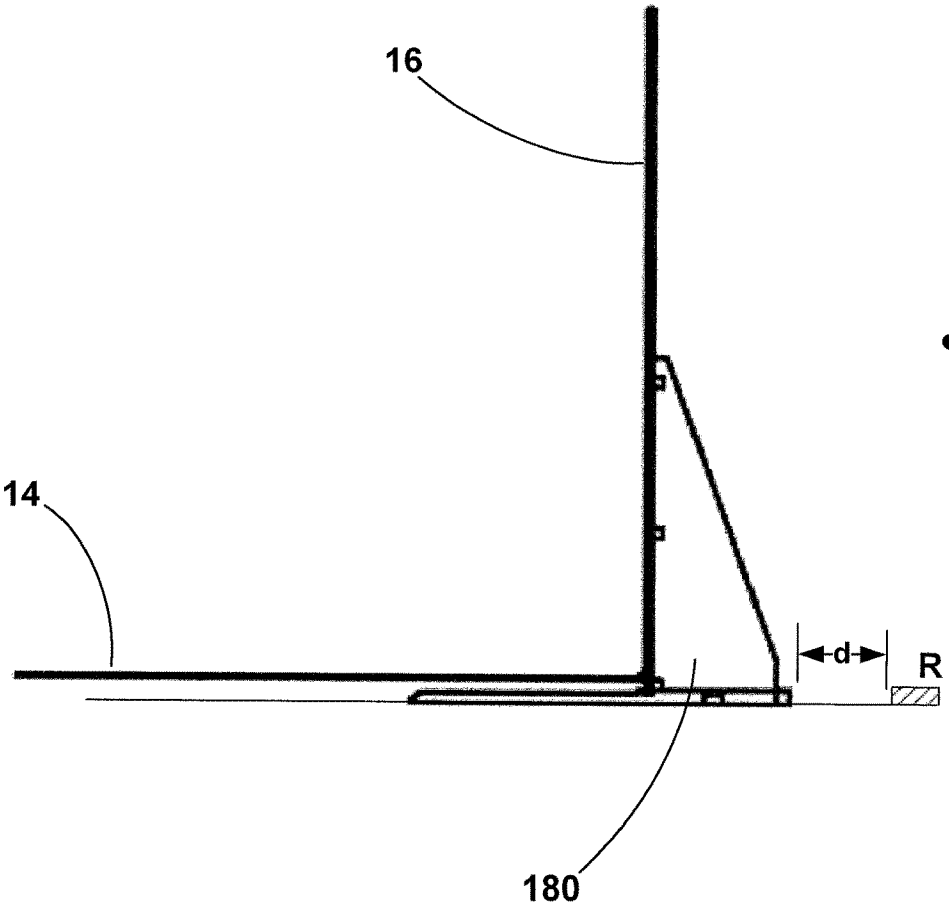

With the releasable coupling in the coupled state, pulling the pull element 14 in the direction indicated by arrow A causes movement of the pusher element 16 in the same direction (i.e. movement of the pusher element in the direction indicated by arrow A' in FIG. 13*b*). This increases the distance, d, between the pusher element 16 and the rear of the merchandise display unit.

Figure 14B:
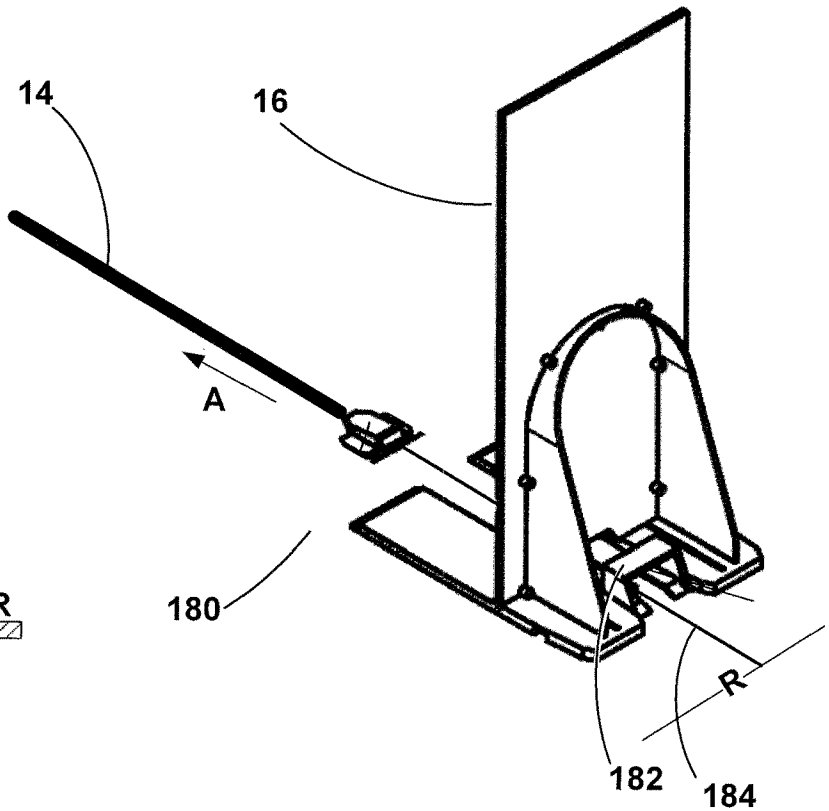
FIGS. 14*a* and 14*b* illustrate a pusher element and releasable coupling of a merchandise display unit according to a first embodiment of the present invention, with the pusher element in a third position.
Figure 14A:
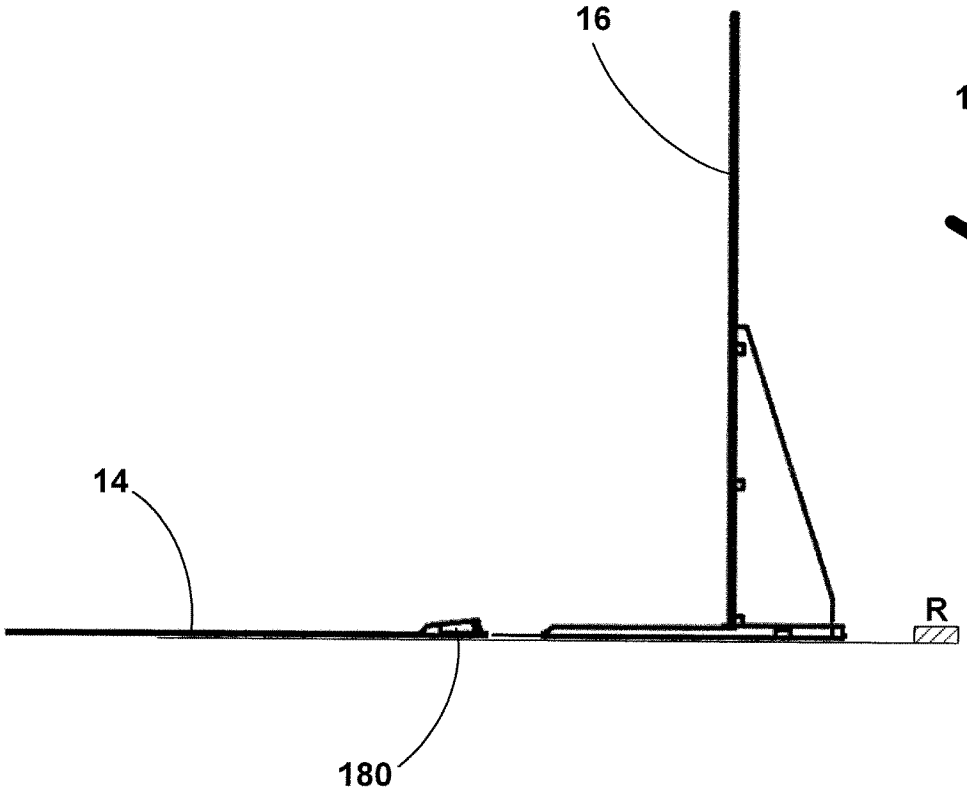

Continued pulling of the pull element 14 will cause continued forward movement of the pusher element 16 so as to push merchandise items contained in the merchandise display unit forward. This can continue until the merchandise items are packed together with the pusher element 16 pressing against a rearmost item and a front item pressing against a stock-limiter at the front edge of the shelf. To limit further forward motion when the merchandise items are in this "fronted" state, the releasable coupling can "uncouple" to uncouple the pull element 14 from the pusher element 16. FIG. 14*a* (side view) and FIG. 14*b* (perspective rear view) illustrate the releasable coupling in an "uncoupled" state. See also FIG. 15*d*, which is described in more detail later.

The uncoupling is effected by the shuttle 180 disengaging, or uncoupling, from the frame 182 so that the pull element 14 and pusher element 16 are uncoupled. In the uncoupled state, continued forward movement of the pull element 14 in the direction indicated by arrow A has no effect on the position of the pusher element 16. That is, the pusher element 16 cannot be moved further forward from the position at which uncoupling occurred, because it is no longer coupled to the means for controlling its movement.

The features of the releasable coupling will now be described in more detail in relation to FIGS. 15*a* to 15*e*.

In FIGS. 15*a* to 15*e:*

Figure 15A:
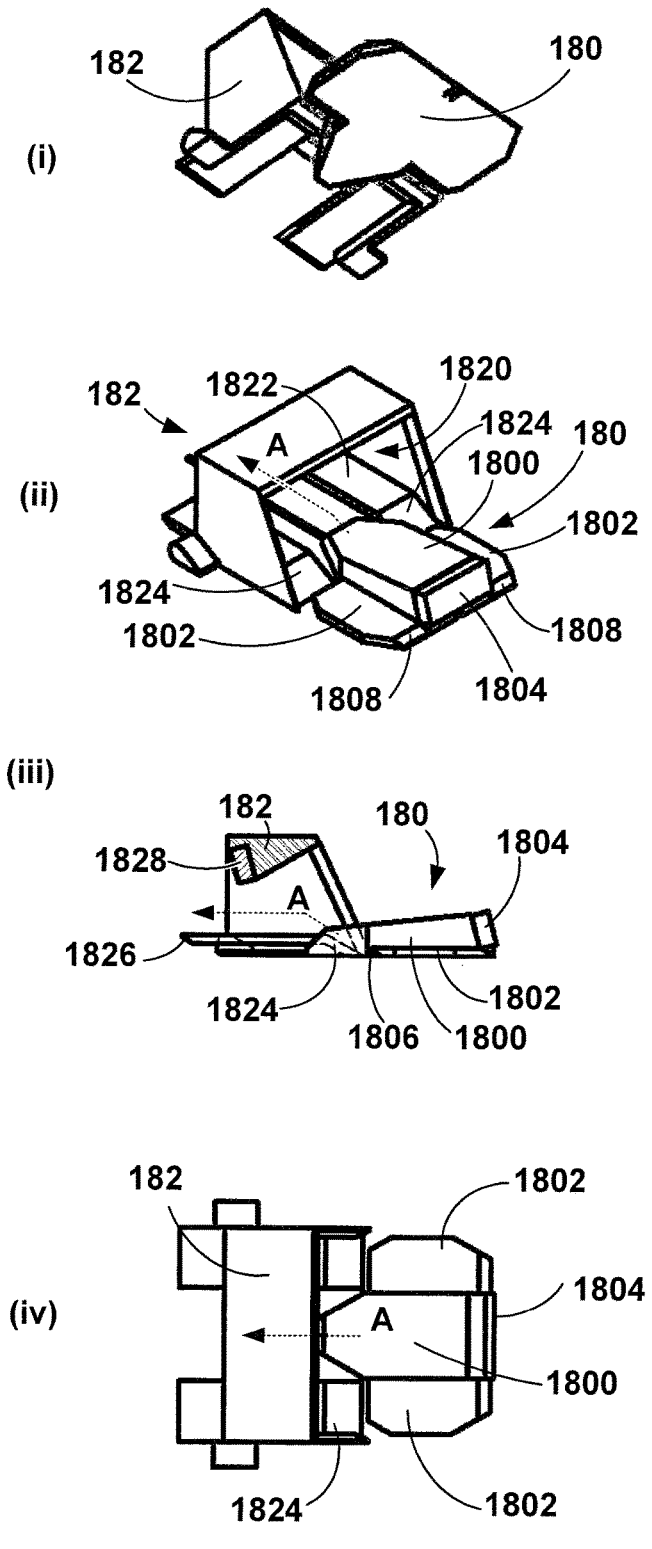
FIGS. 15*a* to 15*e* illustrate different views of elements of the releasable coupling of the merchandise display unit according to the first embodiment of the present invention.
Figure 15B:
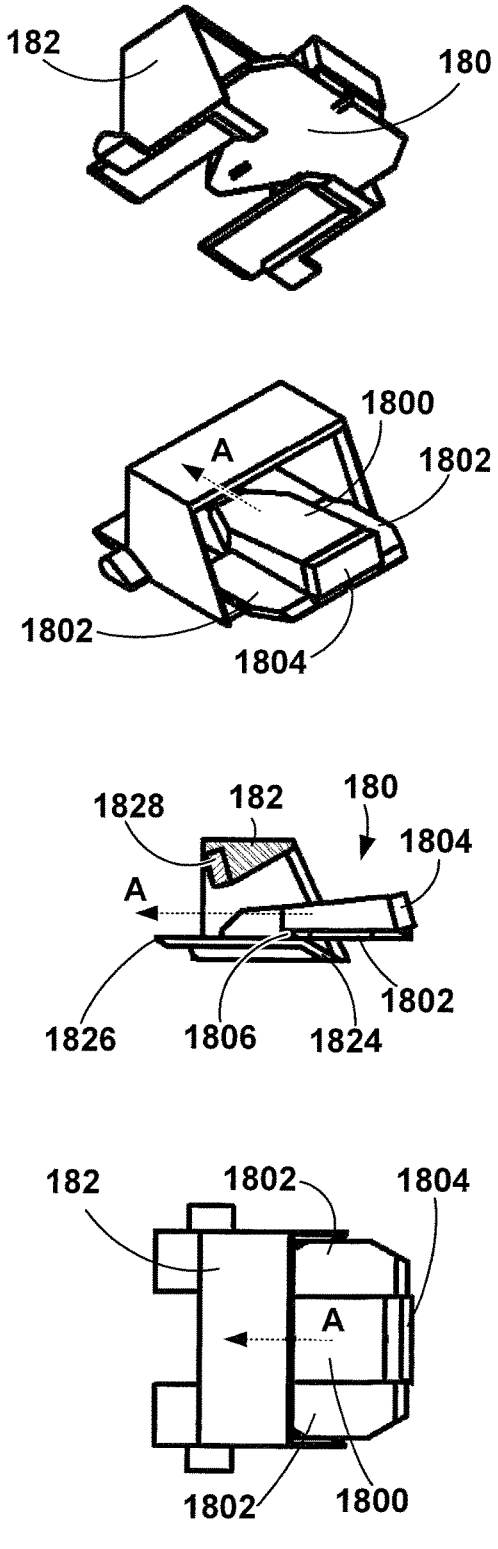
Figure 15C:
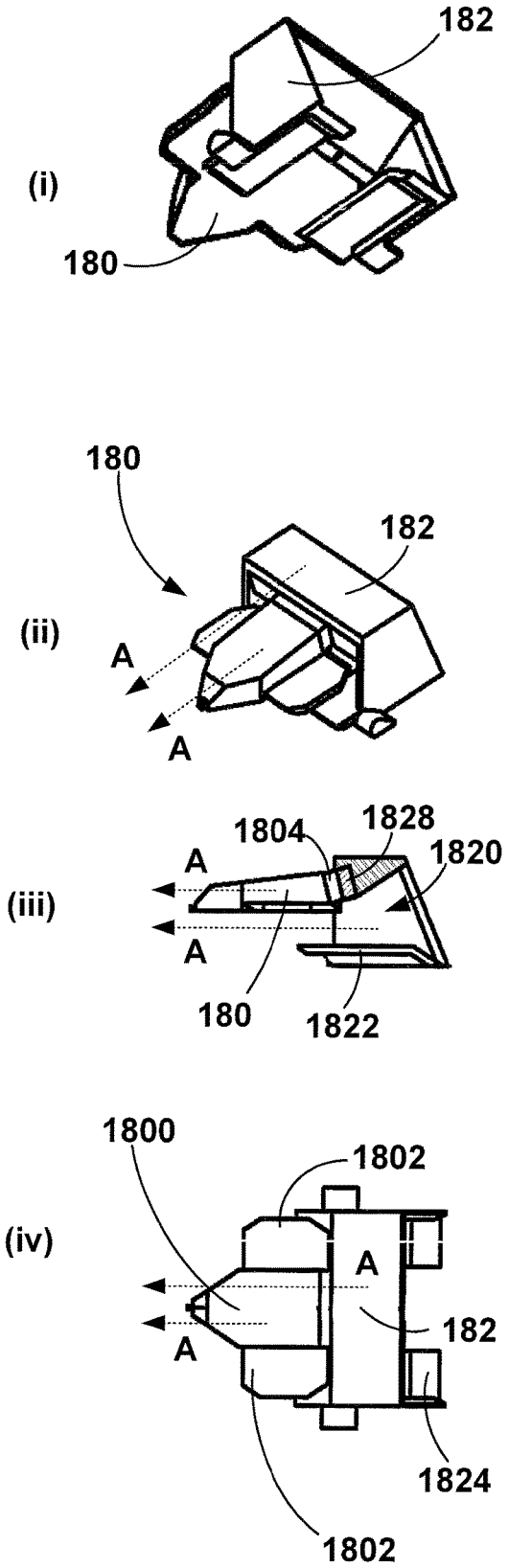
Figure 15D:
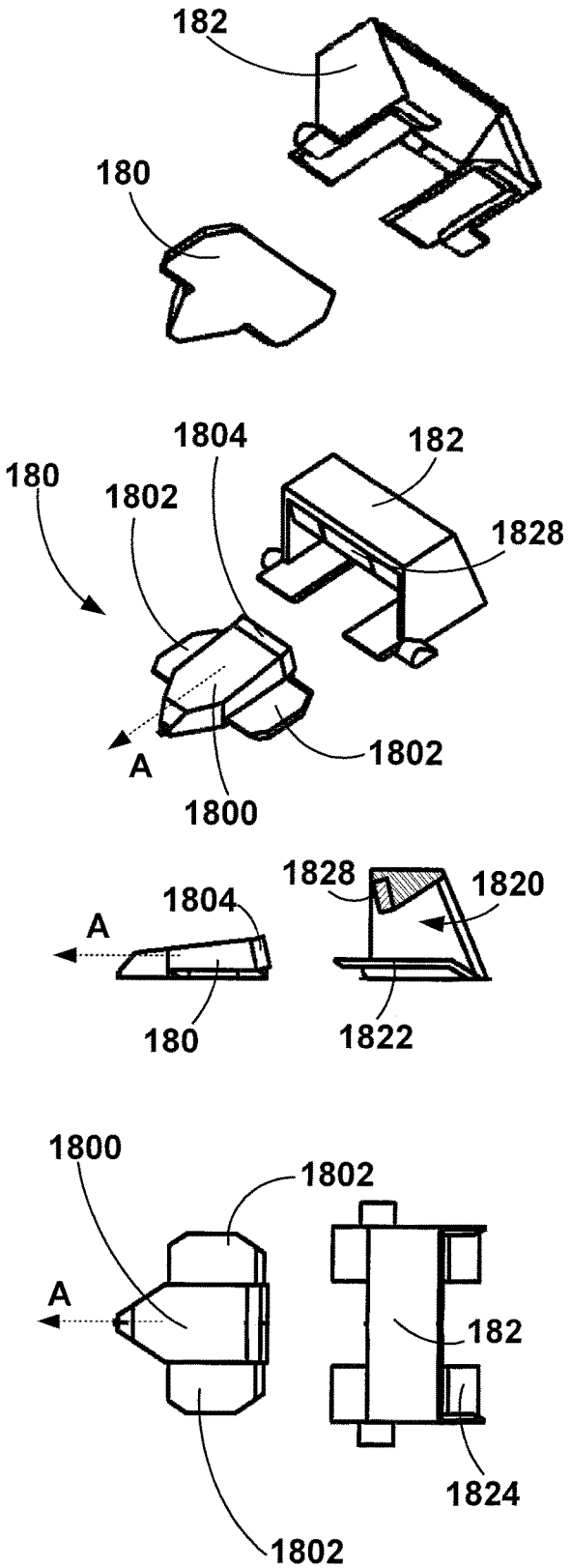
Figure 15E:
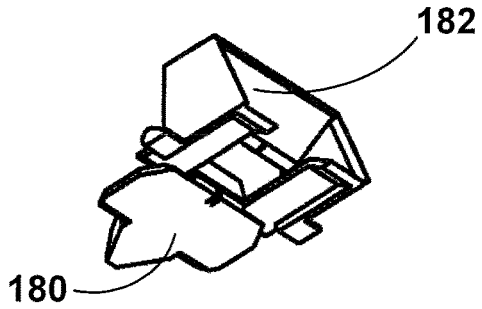
Figure 15E:
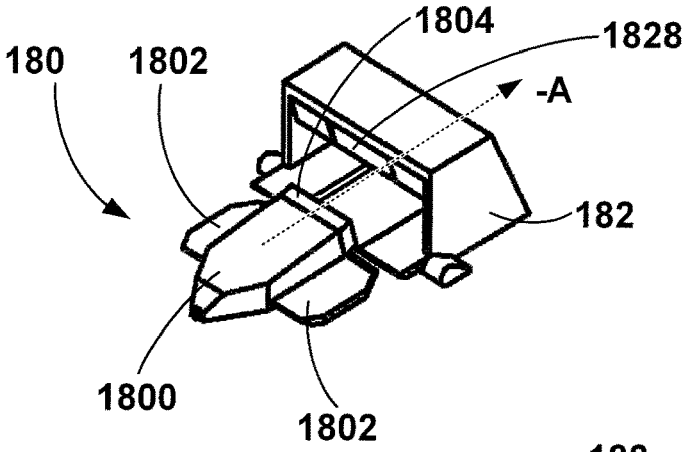
Figure 15E:
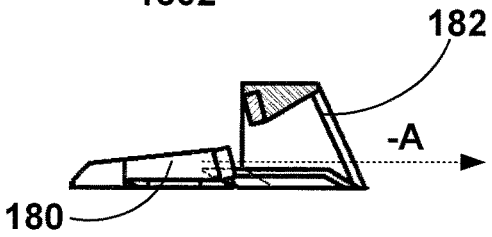
Figure 15E:
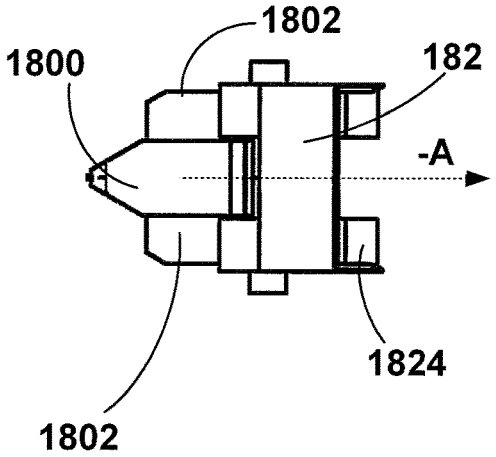

- Images in row (i) show an underside perspective view of the elements of the releasable coupling at different stages of a "front-facing" operation (FIGS. 15*a* to 15*d*), or in a pull element "return" operation (FIG. 15*e*);
- Images in row (ii) show a top perspective view of the elements of the releasable coupling at different stages of the "front-facing" operation (FIGS. 15*a* to 15*d*), or in a pull element "return" operation (FIG. 15*e*);
- Images in row (iii) show a cross-section side view of the elements of the releasable coupling at different stages of the "front-facing" operation (FIGS. 15*a* to 15*d*), or in a pull element "return" operation (FIG. 15*e*); and
- Images in row (iv) show a top plan view of the elements of the releasable coupling at different stages of the "front-facing" operation (FIGS. 15*a* to 15*d*), or in a pull element "return" operation (FIG. 15*e*).

FIG. 15*a* shows the releasable coupling in a pre-coupling state prior to shuttle 180 entering frame 182. FIG. 15*b* shows the releasable coupling still in a pre-coupling state, but with the shuttle 180 passing through frame 182. FIG. 15*c* shows the releasable coupling in a coupled state, with the shuttle 180 attached to the frame 182. FIG. 15*d* shows the releasable coupling in an uncoupled state with the shuttle 180 in a position in the merchandise display unit that is further forward than the frame 182. FIG. 15*e* shows the releasable coupling in an uncoupled state with the shuttle 180 about to pass under the frame 182 in a reverse direction toward a start position.

The shuttle 180, which is coupled to the pull element (not shown), comprises a body portion 1800, two wings 1802, and a coupling element 1804.

The frame 182, comprises a passage 1820, which extends therethrough, and which can allow the shuttle 180 to pass through the frame 182 when the pull element is pulled in the direction indicated by arrow A.

Leading edges 1806 of wings 1802 are inclined downwards and rearwards from an upper surface of each wing 1802, to a lower surface of each wing 1802.

Trailing edges 1808 of wings 1802 are also inclined downwards and rearwards from an upper surface of each wing 1802, to a lower surface of each wing 1802.

An upper surface of bottom wall 1822 of frame 182 defines a surface over which the shuttle 180 can slide when moved in the direction "A", i.e. during a front-facing operation. A lower surface of the bottom wall 1822 of frame 182 defines a surface under which the shuttle 180 can slide when it moves in an opposite direction (i.e. direction "−A") when the pull element is returned to a stowed position, e.g. after a front-facing operation is complete. This movement in direction "−A" is effected by the biasing element, which acts to pull the shuttle 180 toward a rear of the unit/shelf.

Rearward facing edges 1824 of the bottom wall 1822 are inclined downwards and rearwards from the upper surface of the bottom wall 1822 to a lower surface of the bottom wall 1822. Similarly, front facing edges 1826 of the bottom wall 1822 are inclined downwards and rearwards from the upper surface of the bottom wall 1822 to a lower surface of the bottom wall 1822.

The frame 182 also comprises a coupling element 1828.

From a position illustrated in FIG. 15*a*, when a store operative pulls the pull element (not shown), the shuttle 180, which is coupled to the pull element, moves forward in a direction A toward the frame 182. As the shuttle 180 moves forward, the leading edges 1806 of wings 1802 contact rearward facing edges 1824 of frame 182. The complementary respective surfaces of leading edges 1806 and rearward facing edges 1824 causes the shuttle 180 to be lifted up over the rearward facing edges 1824 on to upper surface of bottom wall 1822 of frame 182 (see FIG. 15*b*, views (i) to (iv)). That is, the underside of wings 1802 of shuttle 180 rest upon upper surface of bottom wall 1822 to slide thereover.

Continued movement of the shuttle 180 in direction A causes the shuttle 180 to pass through the passage 1820 of frame 182 until coupling element 1804 of shuttle 180 is in proximity to coupling element 1828 of frame 182.

The coupling elements 1804 and 1828 comprise magnetic elements, which are configured to mutually attract one another. Thus, when the coupling element 1804 of shuttle 180 is in proximity to coupling element 1828 of frame 182, the coupling element 1804 of shuttle 180 is attracted to coupling element 1828 of frame 182, and vice versa. This causes coupling of the respective coupling elements 1804, 1828 (see FIG. 15*c*, views (i) to (iv)).

With the coupling elements 1804, 1828, in a coupled state, the shuttle 180 is coupled to the frame 182 (and thus the pull element (attached to the shuttle) is coupled to the pusher element (attached to the frame)). Thus, pulling the pull element in direction A causes a pulling force to be transferred to the pusher element via the coupled shuttle 180 and frame 182.

As the pusher element is pulled forward and approaches a rear of a rearmost merchandise item in a column of merchandise items, it will exert a force on the rearmost merchandise item and cause the rearmost merchandise item (and those merchandise items located in front of the rearmost merchandise item) to move forward towards a front edge of the display unit.

When a front merchandise item of the column of merchandise item reaches a stock-limiter at a front edge of the display unit, further movement of the pull element in direction A causes the pusher element to push the rearmost merchandise item in the column to cause the merchandise items to pack ever more tightly together. However, as noted previously, it may be undesirable to pack merchandise items together too tightly, because this may damage the items. Therefore, when a force exerted rearward by the compressed column of items exceeds a force of attraction between the coupling elements 1804, 1828, the coupling elements 1804, 1828 will uncouple. Thus, the shuttle 180 and frame 182 will uncouple and, consequently, so will the pull element and pusher element. This means that, even if the pull element continues to be moved in the direction A, the pusher element will not move forward any further, because it is no longer coupled to the pull element (see FIG. 15*d*, views (i) to (iv)).

Release of the pull element by the store operative causes the pull element to move in an opposite direction to a "front-facing direction", i.e. in a direction denoted by arrow "−A" in FIG. 15*e*. This is under the influence of the biasing element 184, which "pulls" the shuttle 180 and acts to cause the shuttle 180 to return to a start position, i.e. a position in which it is closer to the rear of the display unit than frame 182. This also causes the pull element to "retract".

As the shuttle 180 moves rearwards, the trailing edges 1808 of wings 1802 contact front edges 1826 of bottom wall 1822 of frame 182. The complementary respective surfaces of trailing edges 1808 and front edges 1826 causes the shuttle 180 to pass under the bottom wall 1822 of frame 182 (see FIG. 15*e*, views (i) to (iv)). That is, the top surface of wings 1802 of shuttle 180 pass under lower surface of bottom wall 1822 to slide thereunder.

Continued movement of the shuttle 180 in direction "−A" under the influence of the biasing element 184 causes the shuttle 180 to pass under the frame 182 for onwards movement to its start position.

In relation to the second embodiment, first element of the releasable coupling comprises a shuttle 280 coupled to the pull element 14. The second element of the releasable coupling comprises a biasing element 282 mounted on the pusher element 16. Shuttle 280 is also coupled to an end of a biasing element 284. An opposite end of the biasing element 284 is coupled to a rear "R" of the unit/shelf. The biasing element 284 is configured to urge the shuttle 280 towards the rear "R" of the unit/shelf.

Figure 16B:
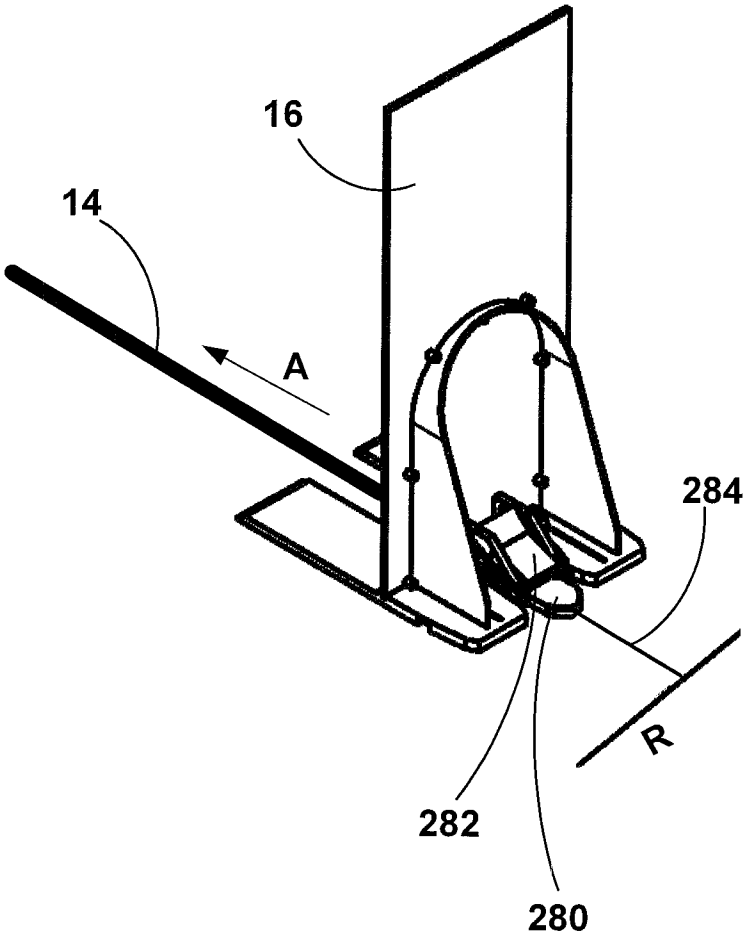
FIGS. 16*a* and 16*b* illustrate a pusher element and releasable coupling of a merchandise display unit according to a second embodiment of the present invention, with the pusher element in a first position.
Figure 16A:
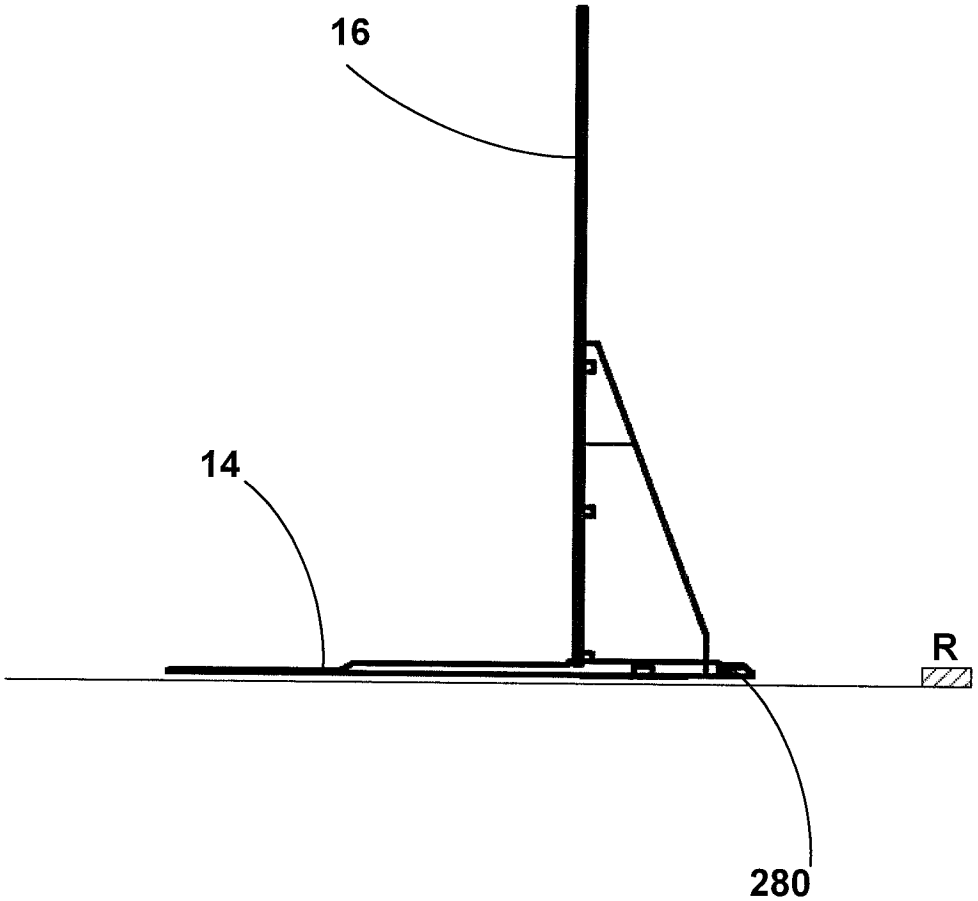

FIGS. 16*a* and 16*b* show a side view (FIG. 16*a*) and a perspective rear view (FIG. 16*b*) of the releasable coupling in a state prior to coupling of the pull element 14 to the pusher element 16.

When a store operative pulls the pull element 14 from the front of the merchandise display unit, this causes shuttle 280, which is coupled to a trailing end of the pull element 14, to move forwards from an initial location at, or towards, a rear of the merchandise display unit. Continued pulling of the pull element 14 in a direction indicated by arrow A in FIG. 16*b* brings the shuttle 280 to a position behind the pusher element 16. FIGS. 16*a* and 16*b* show the shuttle 280 as it is about to engage with biasing element 282 (i.e. pre-coupling). See also FIG. 19*a*, which is described in more detail below.

Pulling the pull element 14 yet further in the direction indicated by arrow A causes the shuttle 280 to press against biasing element 282 (i.e. couple to the biasing element), and thus couple the pull element 14 to the pusher element 16. The releasable coupling in a "coupled" state, i.e. where it couples the pull element 14 to the pusher element 16 is illustrated in FIG. 17*a* (side view) and FIG. 17*b* (perspective rear view). See also FIG. 19*b*, which is described in more detail below.

Figure 17B:
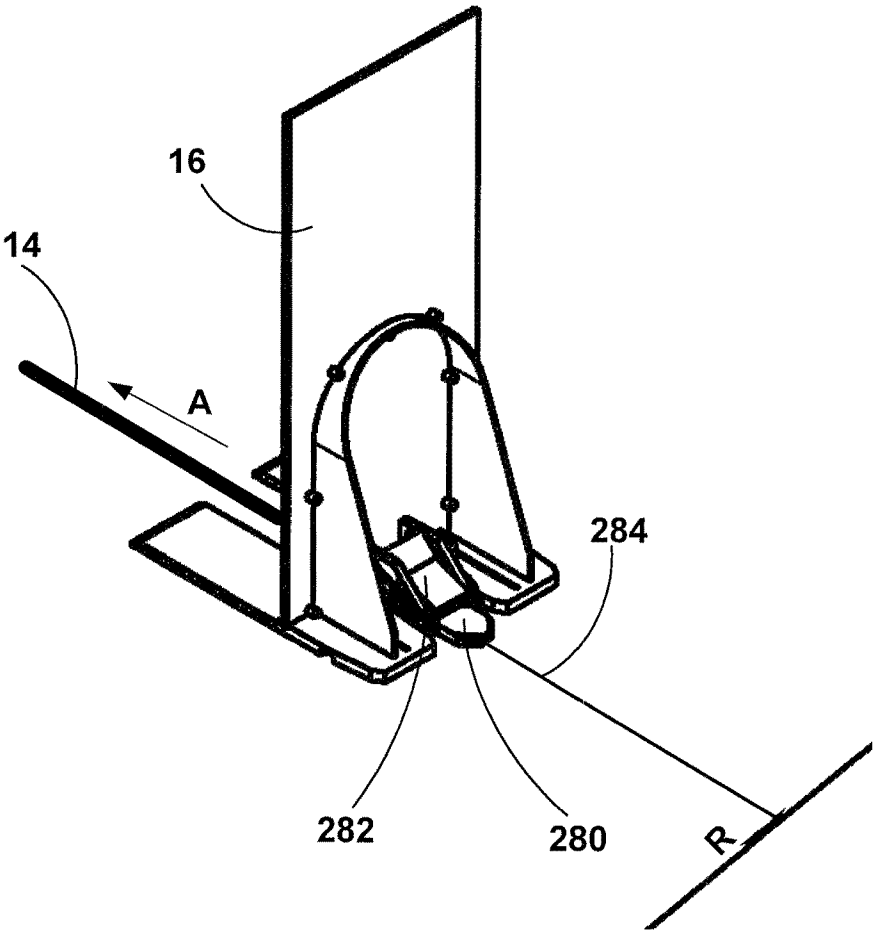
FIGS. 17*a* and 17*b* illustrate a pusher element and releasable coupling of a merchandise display unit according to a second embodiment of the present invention, with the pusher element in a second position.
Figure 17A:
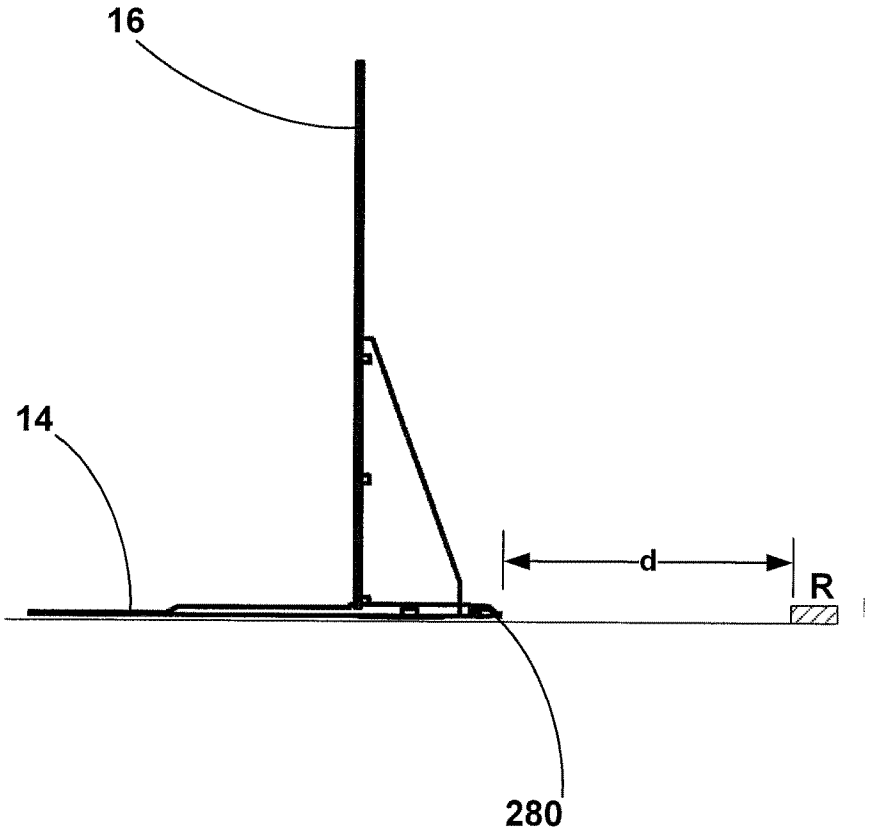

With the releasable coupling in the coupled state, pulling the pull element 14 in the direction indicated by arrow A causes movement of the pusher element 16 in the same direction (i.e. movement of the pusher element in the direction indicated by arrow A in FIG. 17*b*). This increases the distance, d, between the pusher element 16 and the rear of the merchandise display unit.

Figure 18B:
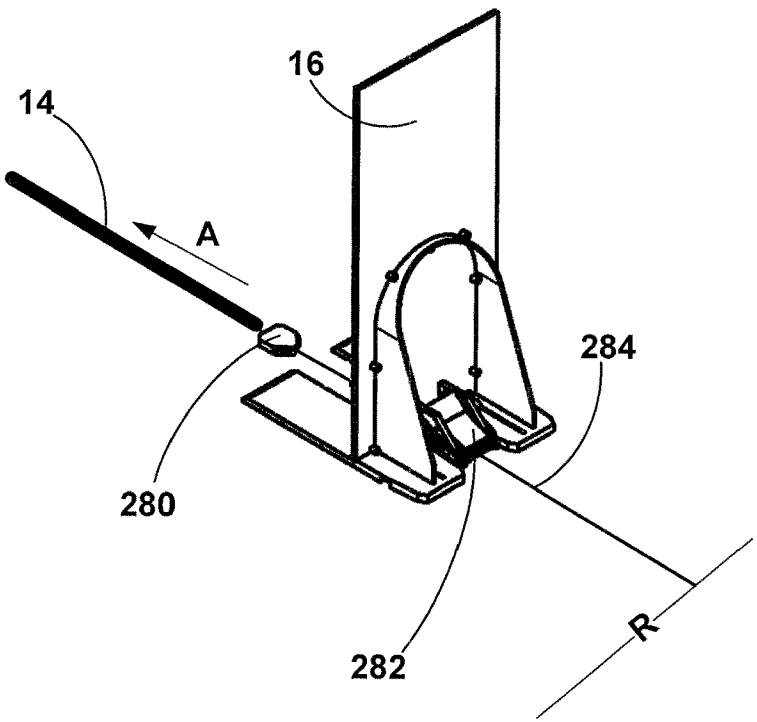
FIGS. 18*a* and 18*b* illustrate a pusher element and releasable coupling of a merchandise display unit according to a second embodiment of the present invention, with the pusher element in a third position.
Figure 18A:
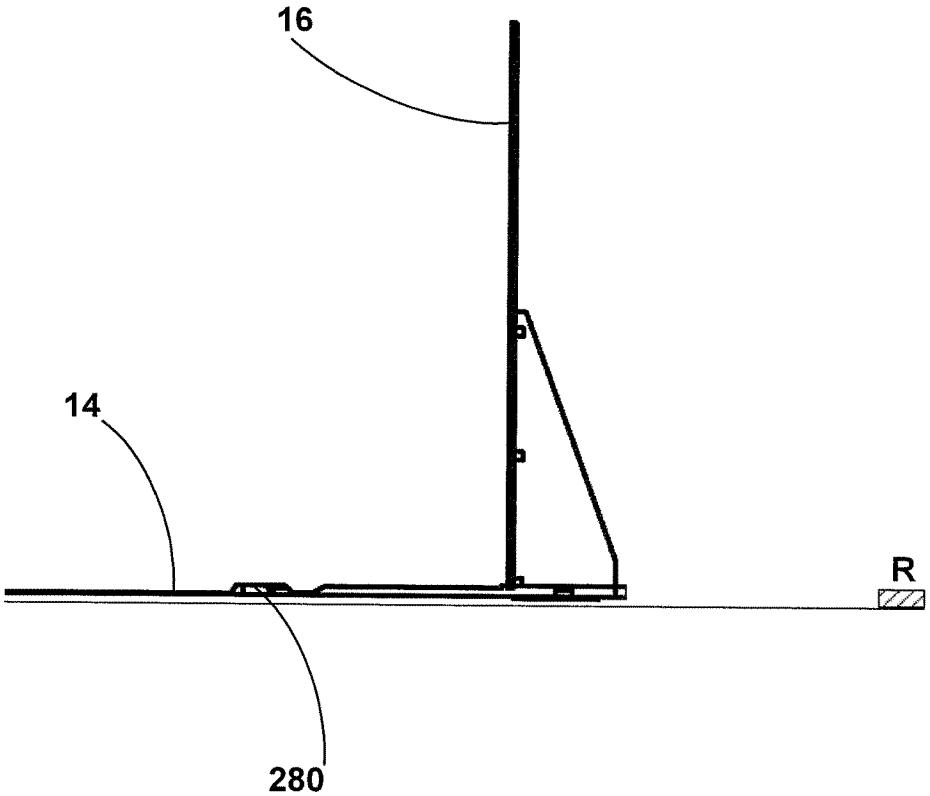

Continued pulling of the pull element 14 will cause continued forward movement of the pusher element 16 so as to push merchandise items contained in the merchandise display unit forward. This can continue until the merchandise items are packed together with the pusher element 16 pressing against a rearmost item and a front item pressing against a stock-limiter at the front edge of the shelf. To limit further forward motion when the merchandise items are in this "fronted" state, the releasable coupling can "uncouple" to uncouple the pull element 14 from the pusher element 16. FIG. 18*a* (side view) and FIG. 18*b* (perspective rear view) illustrate the releasable coupling in an "uncoupled" state. See also FIG. 19*c*, which is described in more detail later.

The uncoupling is effected by the shuttle 280 disengaging, or uncoupling, from the frame 282 so that the pull element 14 and pusher element 16 are uncoupled. In the uncoupled state, continued forward movement of the pull element 14 in the direction indicated by arrow A has no effect on the position of the pusher element 16. That is, the pusher element 16 cannot be moved further forward from the position at which uncoupling occurred, because it is no longer coupled to the means for controlling its movement.

The features of the releasable coupling will now be described in more detail in relation to FIGS. 19*a* to 19*d*.

Figure 19A:
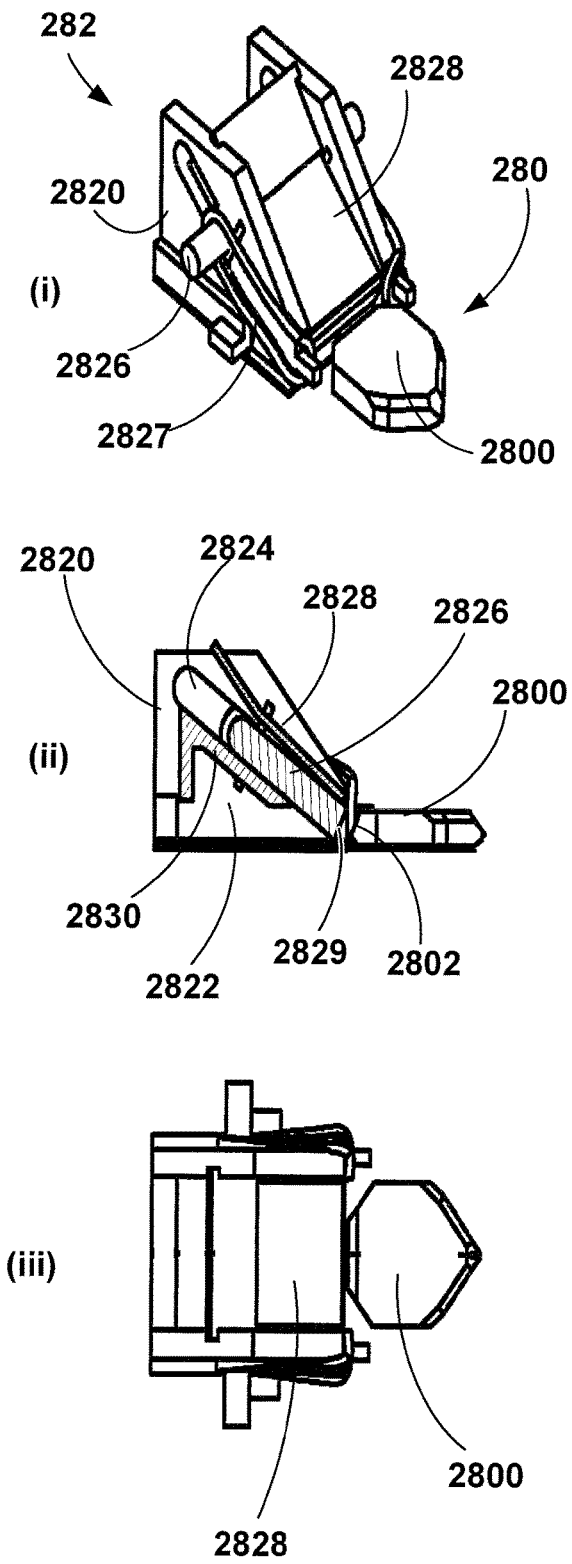
FIGS. 19*a* to 19*d* illustrate different views of elements of the releasable coupling of the merchandise display unit according to the second embodiment of the present invention.
Figure 19B:
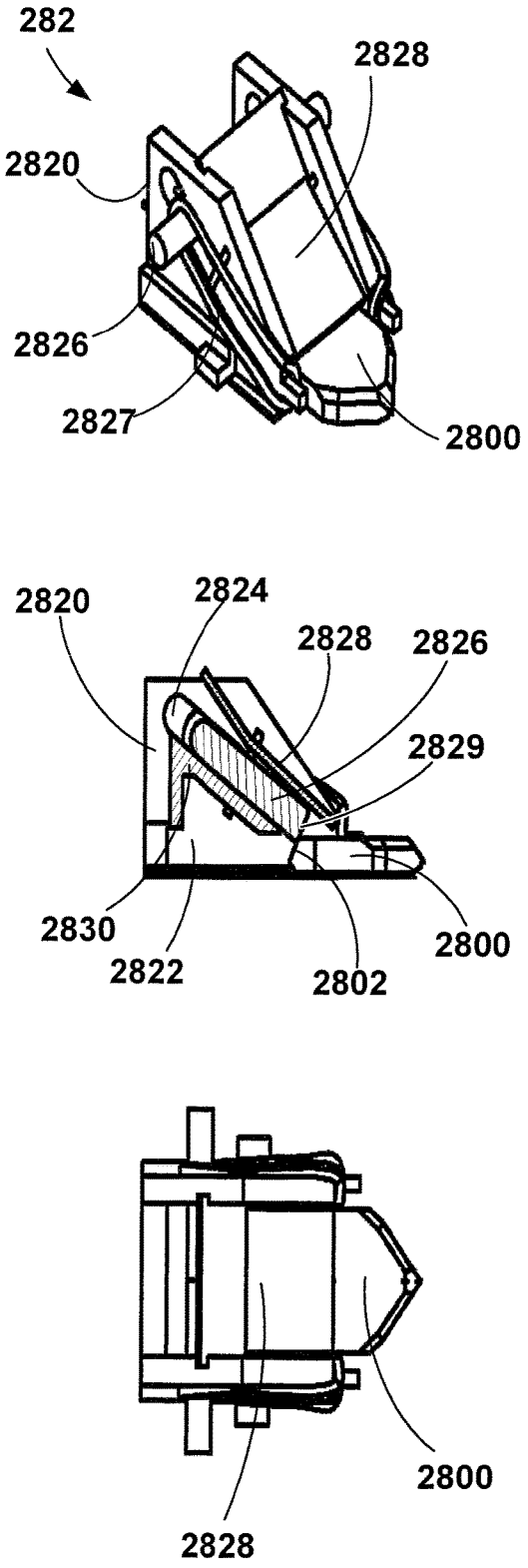
Figure 19C:
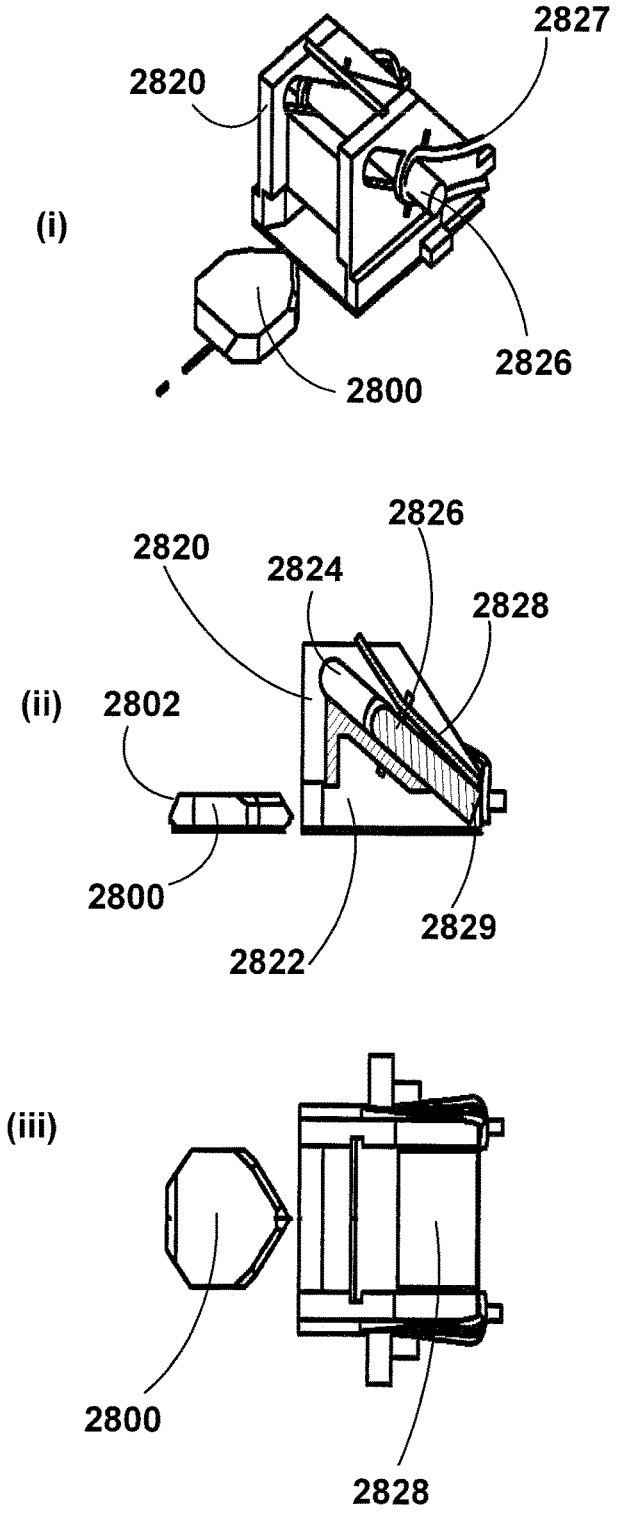
Figure 19D:
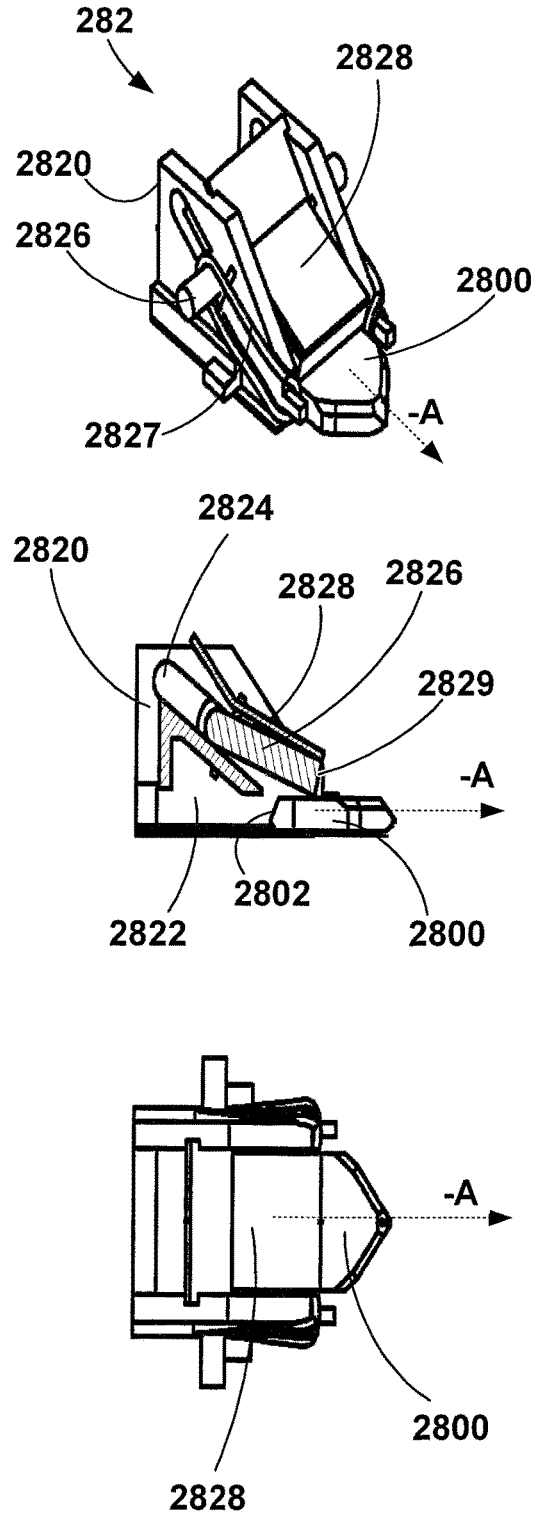

In FIGS. 19*a* to 19*d*:

Images in row (i) show a top perspective view of the elements of the releasable coupling at different stages of a "front-facing" operation (FIGS. 19*a* to 19*c*), or in a pull element "return" operation (FIG. 19*d*);

Images in row (ii) show a cross-section side view of the elements of the releasable coupling at different stages of the "front-facing" operation (FIGS. 19*a* to 19*c*), or in a pull element "return" operation (FIG. 19*d*); and Images in row (iii) show a top plan view of the elements of the releasable coupling at different stages of the "front-facing" operation (FIGS. 19*a* to 19*c*), or in a pull element "return" operation (FIG. 19*d*).

FIG. 19*a* shows the releasable coupling in a pre-coupling state prior to shuttle 280 pushing against biasing element 282. FIG. 19*b* shows the releasable coupling in a coupled state, with the shuttle 280 pushing against biasing element 282. FIG. 19*c* shows the releasable coupling in an uncoupled state with the shuttle 280 in a position in the merchandise display unit that is further forward than the biasing element 282. FIG. 19*d* shows the releasable coupling in an uncoupled state with the shuttle 280 passing through a passage of the biasing element 282 in a reverse direction toward a start position.

The shuttle 280, which is attached to the pull element (not shown), comprises a body portion 2800 and a nose portion 2802.

The biasing element 282 comprises a frame 2820 and a passage 2822, which extends therethrough, and which can allow the shuttle 280 to pass through the frame 2820 when the pull element is pulled in the direction indicated by arrow A, following uncoupling of the shuttle 280 from the biasing element 282, and also when the shuttle 280 passes through the frame 2820 in an opposite direction "−A" when being returned to a start position.

The frame 2820 comprises a channel 2824 in which is disposed a plunger 2826. The plunger 2826 can move within channel 2824 dependent upon the action on the plunger 2826 of the shuttle 280 and a biasing member 2827 configured to bias the plunger 2826 in a direction out of the channel 2824. The frame 2820 also comprises moveable flap 2828, which is biased to inhibit upward deflection of a tip 2829 of the plunger 2826 when the shuttle is moving in a forward direction "A". However, the moveable flap 2828 can pivot upwards, to allow upward deflection of the tip 2829 of the plunger 2826, when the shuttle 280 is moving in a reverse direction, i.e. "−A"—see FIG. 19*d*, view (ii). Frame 2820 also comprises a guide surface 2830, which defines a lower surface of channel 2824, and which can inhibit downward deflection of the tip 2829 of the plunger 2826 when the shuttle is moving in forward direction "A".

From a position illustrated in FIG. 19*a*, when a store operative pulls the pull element (not shown), the shuttle 280, which is coupled to the pull element, moves forward in a direction A toward the biasing element 282. As the shuttle 280 moves forward, the nose 2802 of shuttle 280 contacts tip 2829 of plunger 2826 of biasing element 282. With the nose 2802 and the tip 2829 abutting in this manner, the shuttle 280 and biasing element 282 are coupled (see FIG. 19*b*, views (i) to (iii).

With the nose 2802 of shuttle 280 and the tip 2829 of plunger 2826 in a coupled state, the shuttle 280 is coupled to the biasing element 282 (and thus the pull element (attached to the shuttle) is coupled to the pusher element (attached to the frame)). Thus, pulling the pull element in direction A causes a pulling force to be transferred to the pusher element via the coupled shuttle 280 and frame 282.

As the pusher element is pulled forward and approaches a rear of a rearmost merchandise item in a column of merchandise items, it will exert a force on the rearmost merchandise item and cause the rearmost merchandise item (and those merchandise items located in front of the rearmost merchandise item) to move forward towards a front edge of the display unit.

Forward movement of the shuttle 280, and the interaction of complementary respective surfaces of nose 2802 of shuttle 280 and tip 2829 of plunger 2826, causes the plunger 2826 to slide into the channel 2824 (against the action of biasing member 2827) and also causes the surface of nose 2802 to slide under surface of tip 2829. That is, the nose 2802 of shuttle 280 begins to slide under tip 2829 of plunger 2826 and passes into passage 2822 of biasing element 282.

When a front merchandise item of the column of merchandise item reaches a stock-limiter at a front edge of the display unit, further movement of the pull element in direction A causes the pusher element to push the rearmost merchandise item in the column to cause the merchandise items to pack ever more tightly together. However, as noted previously, it may be undesirable to pack merchandise items together too tightly, because this may damage the items. Therefore, when a force exerted rearward by the compressed column of items exceeds a force at which the plunger 2826 is biased against the shuttle 280, the shuttle 280 will force its way past the plunger, because the surface of nose 2802 of shuttle 280 will completely slide past surface of tip 2829 of plunger 2826 and continue onwards in direction A to pass through the passage 2822. The shuttle 280 and biasing element 282 are thus uncoupled and, consequently, so will the pull element and pusher element be uncoupled. This means that, even if the pull element continues to be moved in the direction A, the pusher element will not move forward any further, because it is no longer coupled to the pull element (see FIG. 19*c*, views (i) to (iv)).

Release of the pull element by the store operative causes the pull element to move in an opposite direction to a "front-facing direction", i.e. in a direction denoted by arrow "−A" in FIG. 19*d*. This is under the influence of the biasing element 284, which "pulls" the shuttle 280 and acts to cause the shuttle 280 to return to a start position, i.e. a position in which it is closer to the rear of the display unit than biasing element 282. This also causes the pull element to "retract".

As the shuttle 280 moves rearwards, under the influence of biasing element 284, it passes through passage 2822 of biasing element 282 and pushes against an underside of plunger 2826, which is now in an extended position. Pushing on the plunger 2826 in this manner causes the plunger to rotate upwards out of the channel 2824, against the action of moveable flap 2828. This widens a gap between the tip 2829 of the plunger 2826 and a bottom of passage 2822, which creates a sufficient gap for the shuttle 280 to continue onwards towards its start position (at, or towards, a rear of the merchandise display unit).

In the third embodiment, the releasable coupling comprises a mechanism that is either located on the pusher element 16, or located behind the pusher element 16 for movement into an engaged relationship with the pusher element 16 during a front-facing operation. The releasable coupling of the third embodiment will be described further below in relation to FIGS. 20*a*, 20*b*, 21*a*, 21*b*, 22*a* and 22*b*.

In relation to the third embodiment, the releasable coupling comprises a unit 300, which comprises a first retractable reel recoil unit, such as, for example, a unit manufactured by Vulcan Spring & Manufacturing Co, of 501 Schoolhouse Rd, Telford, Pa. 18969, USA. The first retractable recoil unit comprises a winding element (not shown) and a spool (not shown), both located in a spool housing 302. A flexible linkage 304 (see FIGS. 22*a* and 22*b*) is wound around the spool and a free end of the flexible linkage 304 extends from a mouth of the spool housing 302. The free end of the flexible linkage 304 is coupled to the pull element 14 (at, or towards a rear end of the pull element 14). The winding element biases the spool to rotate in a first direction (e.g. a counter-clockwise direction) and acts as a resistance against a force applied to the flexible linkage 304 to pull the flexible linkage 304 from the mouth of the spool housing 302, and "unwind" the flexible linkage from the spool. Thus, when a force used to pull the flexible linkage 304 from the mouth of the spool housing 302 (which "unwinds" the flexible linkage from the spool) is removed, the winding element acts to "rewind" the deployed portion of flexible linkage 304 around the spool and return the flexible linkage to a spooled, or stowed, state. Therefore, a biasing resistance of the winding element acts to counter a force applied to the flexible linkage 304, which is applied by way of transferring a force applied to the pull element 14 to pull the pull element from the front of the display unit.

Unit 300 also comprises at least one second retractable recoil unit, similar to the first retractable recoil unit described above, which is configured to operate in an opposite direction to the first retractable recoil unit. A housing of the second retractable recoil unit is denoted by reference numeral 303 in the figure. The housing 303, as with that of the first retractable recoil unit, comprises a winding element (not shown) and a spool (not shown) located therein. A flexible linkage 306 is wound around the spool of the second retractable recoil unit and a free end thereof extends from a mouth of the spool housing 303. The free end of the flexible linkage 306 is coupled to a rear portion of the unit/shelf. The second retractable recoil unit acts as a biasing element (i.e. in a similar manner to biasing elements 184, 284) to "pull" the unit 300 towards a rear of the shelf/unit.

Figure 20B:
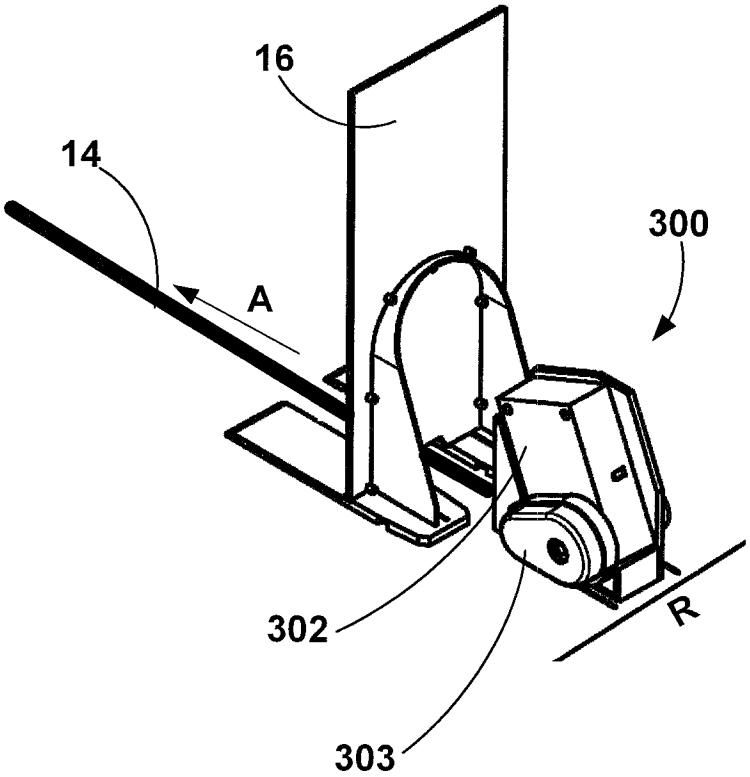
FIGS. 20*a* and 20*b* illustrate a pusher element and releasable coupling of a merchandise display unit according to a third embodiment of the present invention, with the pusher element in a first position.
Figure 20A:
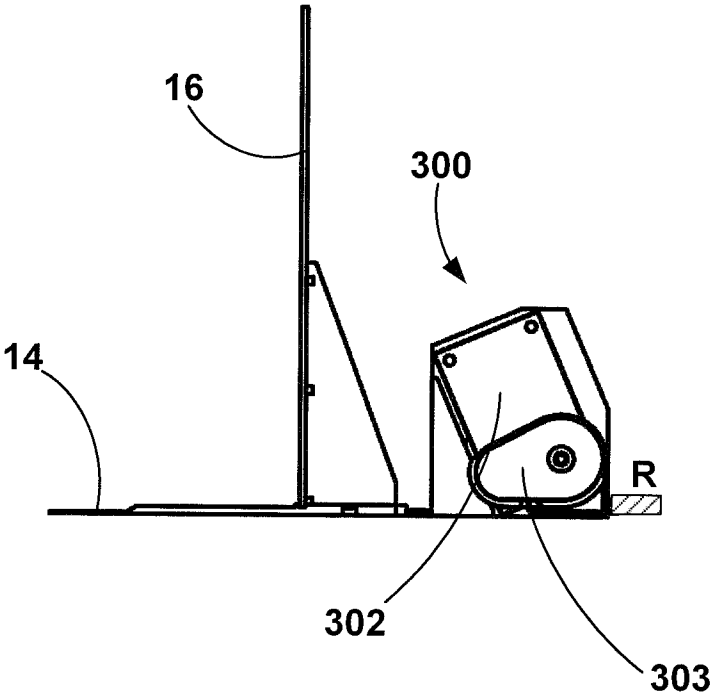

FIGS. 20*a* and 20*b* show a side view (FIG. 20*a*) and a perspective rear view (FIG. 20*b*) of the releasable coupling in a state prior to coupling of the pull element 14 to the pusher element 16. As can be seen, the unit 300 is located behind the pusher element 16 (i.e. toward a rear portion of the display unit) and is spaced from the pusher element 16. At this stage, there is no contact between the unit 300 and the pusher element 16.

When a store operative pulls the pull element 14 from the front of the merchandise display unit, this causes unit 300, which is coupled to pull element 14 by flexible linkage 304, to move forwards from an initial location illustrated in FIGS. 20*a* and 20*b* toward the pusher element 16. This also causes flexible linkage 306 to be deployed from the second retractable recoil unit, i.e. it "unwinds" from the spool of the second retractable recoil unit. Continued pulling of the pull element 14 in a direction indicated by arrow A in FIG. 20*b* brings the unit 300, by a sliding motion along the support surface of the display unit, to a position behind the pusher element 16. At this stage, the force necessary to effect forward movement of the unit 300 (applied via pull element 14) is less than the force necessary to overcome the biasing resistance of the winding element of the first retractable recoil unit and so the flexible linkage 304 does not unwind from the spool.

Pulling the pull element 14 yet further in the direction indicated by arrow A causes the at least a portion of unit 300 to abut at least a portion of pusher element 16 and yet more of the flexible linkage 306 to be deployed from second retractable recoil unit. At this point, the unit 300 is effectively "engaged", or "coupled", to the pusher element 16 and thus the pull element 14 and the pusher element 16 are also coupled. The releasable coupling in a "coupled" state, i.e. where it couples the pull element 14 to the pusher element 16, is illustrated in FIG. 21*a* (side view) and FIG. 21*b* (perspective rear view).

Figure 21B:
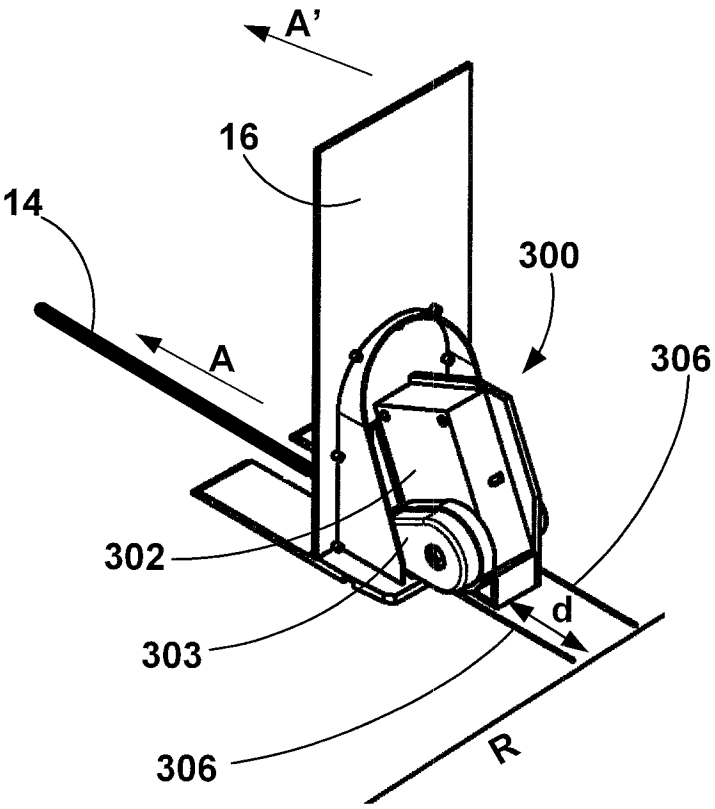
FIGS. 21*a* and 21*b* illustrate a pusher element and releasable coupling of a merchandise display unit according to a third embodiment of the present invention, with the pusher element in a second position and in a coupled state.
Figure 21A:
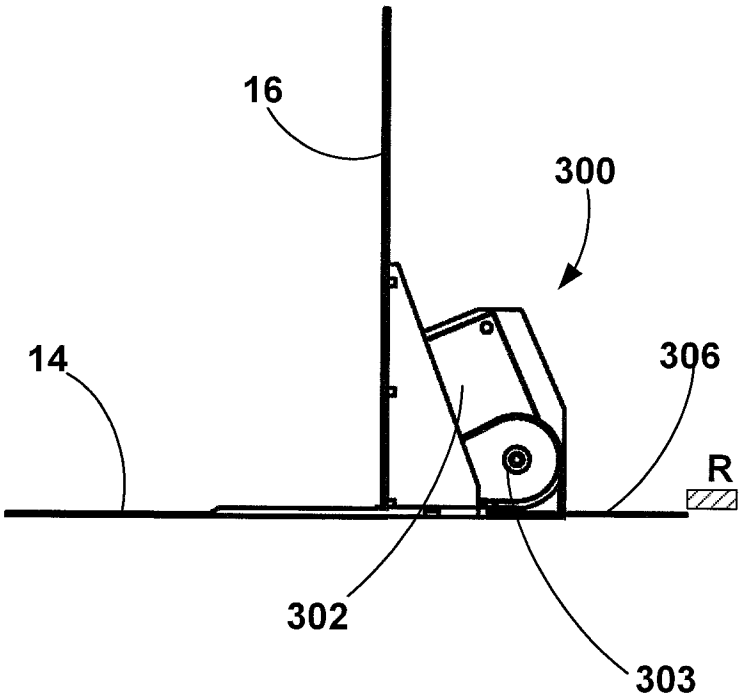

With the releasable coupling in the coupled state, i.e. the unit 300 pressing against the pusher element 16, pulling the pull element 14 in the direction indicated by arrow A causes movement of the pusher element 16 in the same direction (i.e. movement of the pusher element in the direction indicated by arrow A' in FIG. 21*b*). This increases the distance, d, between the pusher element 16 and the rear of the merchandise display unit. Yet more flexible linkage 306 is deployed from the second retractable recoil unit.

Continued pulling of the pull element 14 will cause continued forward movement of the pusher element 16 so as to push merchandise items contained in the merchandise display unit forward. This can continue until the merchandise items are packed together with the pusher element 16 pressing against a rearmost item and a front item pressing against a stock-limiter at the front edge of the shelf. To limit further forward motion when the merchandise items are in this "fronted" state, the releasable coupling can "uncouple" to uncouple the pull element 14 from the pusher element 16. FIG. 22*a* (side view) and FIG. 22*b* (perspective rear view) illustrate the releasable coupling in an "uncoupled" state.

In the "uncoupled" state, the unit 300 remains pressed against the pusher element 16. However, uncoupling is effected when the force necessary to effect forward movement of the unit 300 (applied via pull element 14) is greater than the force necessary to overcome the biasing resistance of the winding element of the first retractable recoil unit. This occurs when the force applied in direction A is resisted by a force in an opposite direction, and which oppositely directed force arises from resistance of the merchandise items, or the packaging thereof, to compression (i.e. by being squeezed between the pusher element 16 and the stock-limiter at the front edge of the display unit). To avoid over-compression of the merchandise items, which would arise through increasing the force applied in the direction A, once the force in direction A reaches a particular threshold, the flexible linkage 304 unwinds from spool. Thus forward motion of the pull element 14 can continue, but this does not cause further forward motion of the pusher element 16. That is, the pusher element 16 cannot be moved further forward from the position at which uncoupling occurred, because it is no longer "coupled" to the pull element 14 via the unit 300. The threshold comprises the biasing resistance of the winding element of the first retractable recoil unit. Thus, once the force in direction A exceeds this biasing resistance, the flexible linkage begins to unwind from the spool.

Upon removal of the force applied to the pull element, the winding element acts to "rewind" the deployed portion of flexible linkage 304 and causes this deployed portion to be retracted into the spool housing 302 and wound around spool. This also causes retraction of the pull element 14.

Figure 22B:
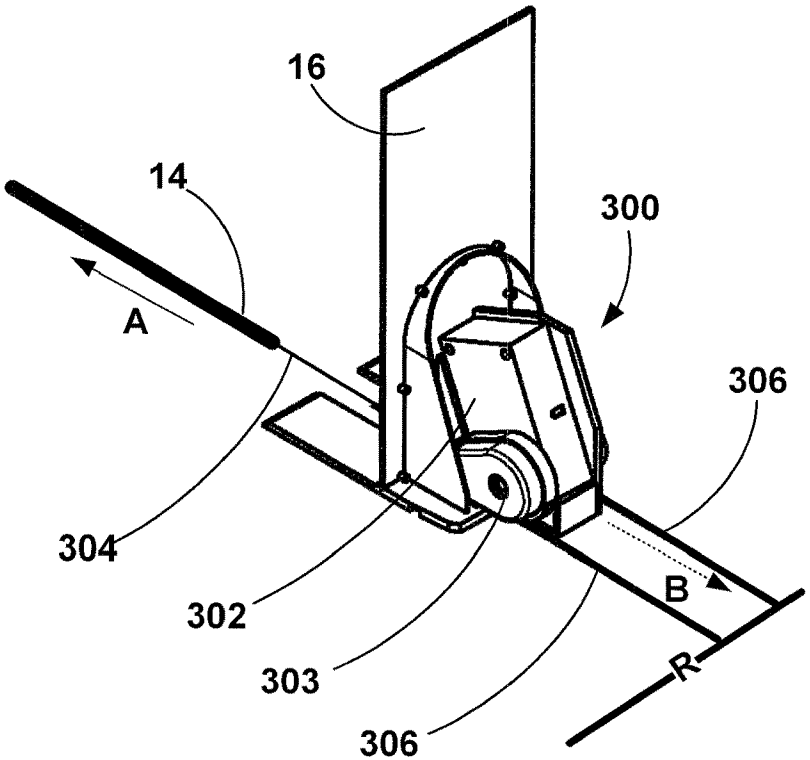
FIGS. 22*a* and 22*b* illustrate a pusher element and releasable coupling of a merchandise display unit according to a third embodiment of the present invention, with the pusher element in a second position and in an uncoupled state.
Figure 22A:
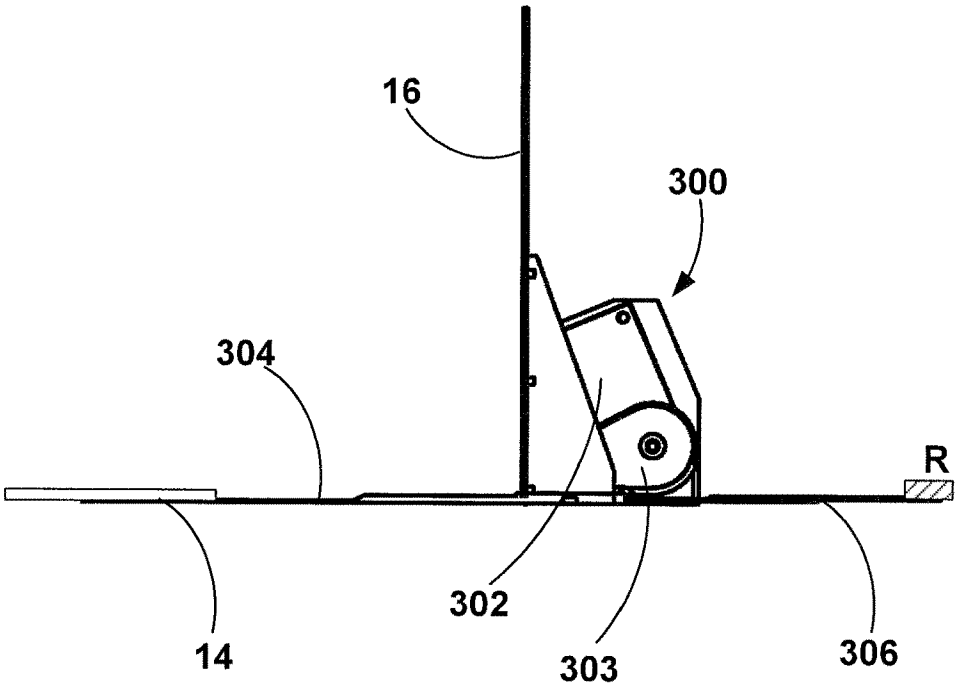

In the third embodiment, the second retractable recoil unit, upon removal of the force pulling the unit in a forward direction, urges the retractable reel recoil unit 300 to a start position (i.e. at, or towards, a rear of the display unit—in a direction indicated by arrow B in FIG. 22*b*). The biasing resistance of the winding element of the second retractable recoil unit causes the deployed portion of flexible linkage 306 to be retracted into spool housing 303 and wound around the spool of the second retractable recoil unit. This causes the unit 300 to move from a forward position to a start position when a force applied to pull element is removed.

In the above-described first and second embodiments, the biasing elements 184, 284, can comprise retractable recoil units similar to those described in relation to the above-described third embodiments. Such units may operate to "pull" the respective shuttles to effectively retract the respective pull elements from a deployed position to a retracted position.

In the above-described one or more embodiments, the merchandise display units are described, in an example, as being discrete units for location on a shelf. In an optional arrangement, the merchandise display units may comprise an engagement element for coupling the unit to a shelf of a merchandise display system (and/or to a cooperative engagement element located on a shelf of a merchandise display system). In one or more further optional arrangements, the merchandise display units may comprise a runner system for engagement with a cooperative runner system of the cooperative engagement element of the shelf of the merchandise display system, the runner system configured to permit movement of the unit from a display position on the shelf to an extended position in front of said shelf. Thus, the unit may be moved from the display position to an extended position where the unit extends from the shelf so that a store operative can re-stock the unit with merchandise items and/or remove merchandise items from the unit. In one or more yet further optional arrangements, the merchandise display unit may be removable from the shelf of the merchandise display system, for example, to allow re-stocking of the unit at a remote location and/or stock removal from the unit at a remote location.

In another optional arrangement, instead of using discrete units in the merchandise display system, the system may be configured such that a shelf (or shelves) of the merchandise display system act as the support surface (or surfaces) of the merchandise display unit. Multiple lateral walls may be coupled directly to a top surface of a shelf panel of each shelf and spaced apart to separate each shelf into a number of "channels", into each of which may be loaded a plurality of merchandise items. The "channels" effectively form the merchandise display units described above. In such an optional arrangement, a pusher element 16 comprises at least one magnet on an underside to couple the pusher element 16 to the upper surface of the shelf. The at least one magnet may assist in maintaining the pusher element 16 in an upright orientation, i.e. prevent tipping of the pusher element 16 when it slideably traverses the surface of the shelf (e.g. under influence of a pulling force exerted thereon by way of pull element 14).

In an optional arrangement, multiple pull elements may be connected together by way of a connecting element. The connecting element may be located at a front edge of a shelf and may be disposed transverse to each of the pull elements. The connecting element may allow a store operative to perform a front-facing operation on multiple columns of products/merchandise items by pulling the connecting element away from a front edge of a shelf. This action will exert a pulling force on each pull element connected to the connecting element and, in turn, will cause the pusher element of each display unit to move forward to exert a force on a rear-most product/merchandise in its respective column Thus, multiple columns of products/merchandise items may be front-faced using a single action. Whilst this arrangement may be useful for products/merchandise items that are susceptible to damage when excessive pressures are exerted on such products/merchandise items, it may also be useful for front-facing products/merchandise items that are not susceptible to damage under high pressures. That is a plurality of columns of products/merchandise items can be front-faced using this arrangement.

In an optional arrangement, a pull element may be coupled to a motor, which is operative to exert a pull force on the pull element responsive to a signal initiating a front-facing operation. Where there are multiple columns of products/merchandise items, each pull element may be coupled to a respective motor. Alternatively, in an arrangement where multiple pull elements are connected by a connecting element, a single motor reel may be coupled to the connecting element and can operate to initiate a front-facing operation on multiple columns of products/merchandise items. The signal to initiate a front-facing operation may be issued by a controller periodically and/or responsive to an actuation signal received from a user-operable control switch. Additionally and/or alternatively, a shelf may comprise one or more sensors operative to detect presence/absence of a product, i.e. detect empty space at least at a front portion of a shelf. Responsive to detection of empty space, the sensor can issue a signal to the controller which, in turn, issue the signal to initiate the front-facing operation. There may be at least one sensor per column of products/merchandise items, or at least one sensor operative to detect empty space in multiple columns. The arrangement described above for an automated arrangement to front-face products/merchandise items may be employed for a plurality of shelves, so that an entire gondola may be front-faced in a single operation.

In an optional arrangement, the merchandise display unit may comprise a shelf-ready packaging unit. That is, the unit may be stocked with merchandise items by a merchandise item supplier and wrapped in packaging material to form a shelf-ready packaging (SRP) unit. The SRP unit can be transported to a store in this state, at which point the packaging material can be removed so that the merchandise display unit can be located on a merchandise display system. This arrangement may reduce the workload of store operatives, because the merchandise item is pre-loaded with merchandise items.

In the above-described one or more embodiments, the merchandise display units comprise, in an example, lateral side walls that extend to a height greater than a height of merchandise items that the merchandise display units are intended to hold (i.e. the merchandise items in a "column" are substantially surrounded by the lateral walls to either side of the column of items and the support surface beneath the column). In one or more further optional arrangements, the lateral side walls may be lower than a height of the merchandise items that the merchandise display units are intended to hold.

In the above-described one or more embodiments, the pull element comprises an elongate member, which comprises a flexible linkage (which may be a nylon string, or cord). Optionally, the flexible linkage may comprise a relatively thin metal cable, string, or cord. Optionally, in one or more other embodiments, the pull element may comprise a flexible elongate strip. Optionally, in one or more further embodiments, the pull element may comprise a rigid elongate strip. In one or more embodiments comprising a rigid elongate strip, elements to pull the pull element to a retracted position may not be required, because moving the pull element to a retracted position may be achieved by pushing the pull element in a rearwards direction.

In the illustrated embodiments, pusher element 16 is shown with a pushing plate upstanding from a base plate. In the illustrated examples, the pushing plate comprises a substantially straight plate that is substantially perpendicular to the base plate. However, in optional arrangements, the pushing plate may be bent, or comprise a non-flat pushing surface. The shape of a pushing surface of the pushing plate may be configured so as to increase friction between the pushing surface of the pusher element and a rearmost merchandise item. This may prevent the rearmost merchandise item sliding upwards out of position when under compression before the shuttle/retractable flexible linkage is released. In other optional arrangements, a suitable surface finish of the pushing surface of pushing plate may be employed to effect the same result.

Any references made herein to orientation (e.g. top, bottom, upper, lower, front, back, and rear) are made for the purposes of describing relative spatial arrangements of the features of the apparatus, and are not intended to be limiting in any sense.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, the terms "a" or "an" are employed to describe elements and components of the invention. This is done merely for convenience and to give a general sense of the invention. This description should be read to include one or at least one and the singular also includes the plural unless it is obvious that it is means otherwise.

In view of the foregoing description it will be evident to a person skilled in the art that various modifications may be made within the scope of the invention. For example, embodiments in accordance with the invention are not limited to any of the particular materials disclosed herein. Other materials suitable for performing the function described herein for a particular material may also be utilized in embodiments of the invention.

The scope of the present disclosure includes any novel feature or combination of features disclosed therein either explicitly or implicitly or any generalisation thereof irrespective of whether or not it relates to the claimed invention or mitigate against any or all of the problems addressed by the present invention. The applicant hereby gives notice that new claims may be formulated to such features during prosecution of this application or of any such further application derived therefrom. In particular, with reference to the appended claims, features from dependent claims may be combined with those of the independent claims and features from respective independent claims may be combined in any appropriate manner and not merely in specific combinations enumerated in the claims.

The invention claimed is:

1. A display unit for a merchandise display system, comprising:

a support surface for supporting a plurality of merchandise items, the support surface defining a travel path for said plurality of merchandise items between a rear of the display unit and a front of the display unit;

a pusher element disposed for movement relative to said support surface along said travel path;

an actuation member coupleable to said pusher element and operative to control movement of said pusher element; and a releasable coupling for coupling said pusher element to said actuation member, said releasable coupling configured to couple said pusher element to said actuation member when an actuation force is applied to said actuation member, and to uncouple said pusher element from said actuation member when said actuation force applied to said actuation member exceeds a threshold;

wherein said releasable coupling comprises a first element coupled to said actuation member and a second element disposed on said pusher element;

wherein said first element comprises a first coupling element and said second element comprises a second coupling element, said first and second coupling elements comprise respective complementary elements, and further wherein said actuation force is transferred from said actuation member to said pusher element through interaction of said complementary elements; and wherein said first coupling element comprises a first magnet comprising a first polarity and said second coupling element comprises a second magnet comprising a second, opposite, polarity to effect coupling between said first and second elements.

2. A display unit according to claim 1, wherein said threshold comprises a force required to overcome a force of magnetic attraction between said first and second magnets.

3. A display unit for a merchandise display system, comprising:

a support surface for supporting a plurality of merchandise items, the support surface defining a travel path for said plurality of merchandise items between a rear of the display unit and a front of the display unit;

a pusher element disposed for movement relative to said support surface along said travel path;

an actuation member coupleable to said pusher element and operative to control movement of said pusher element; and a releasable coupling for coupling said pusher element to said actuation member, said releasable coupling configured to couple said pusher element to said actuation member when an actuation force is applied to said actuation member, and to uncouple said pusher element from said actuation member when said actuation force applied to said actuation member exceeds a threshold;

wherein said releasable coupling comprises a first element coupled to said actuation member and a second element disposed on said pusher element;

wherein said first element comprises a first coupling element and said second element comprises a second coupling element, said first and second coupling elements comprise respective complementary elements, and further wherein said actuation force is transferred from said actuation member to said pusher element through interaction of said complementary elements; and wherein said first coupling element comprises a first formation and said second coupling element comprises a second formation, said first formation configured to frictionally engage said second formation to effect coupling between said first and second elements.

4. A display unit according to claim 3, wherein said second element comprises a biasing member to urge said second coupling element to a position where said second formation of said second coupling element is located for frictional engagement with said first formation.

5. A display unit according to claim 4, wherein said threshold comprises a force required to overcome a force exerted by said biasing member to move said second formation from said position.

6. A display unit for a merchandise display system, comprising:

a support surface for supporting a plurality of merchandise items, the support surface defining a travel path for said plurality of merchandise items between a rear of the display unit and a front of the display unit;

a pusher element disposed for movement relative to said support surface along said travel path;

an actuation member coupleable to said pusher element and operative to control movement of said pusher element; and a releasable coupling for coupling said pusher element to said actuation member, said releasable coupling configured to couple said pusher element to said actuation member when an actuation force is applied to said actuation member, and to uncouple said pusher element from said actuation member when said actuation force applied to said actuation member exceeds a threshold;

wherein said releasable coupling comprises a pusher unit coupled to said actuation member, said pusher unit comprising a housing at least a portion of which is configured to abut at least a portion of said pusher element, and further wherein said actuation force is transferred from said actuation member to said pusher element through interaction of said pusher unit and said pusher element.

7. A display unit according to claim 6, wherein said pusher unit comprises a flexible linkage for coupling said pusher unit to said actuation member.

8. A display unit according to claim 7, wherein said pusher unit further comprises: a storage element, from which said flexible linkage can be deployed; and a biasing element configured to act on said storage element to urge said flexible linkage to a stowed state in said storage element.

9. A display unit according to claim 8, wherein said actuation member is coupled to said pusher element, and a force applied to said actuation member is transferred to said pusher element when said flexible linkage is in said stowed state.

10. A display unit according to claim 9, wherein said actuation member is uncoupled from said pusher element when said flexible linkage is in a deployed state.

11. A display unit according to claim 10, wherein said flexible linkage is deployable when said force applied to said actuation member exceeds a force applied by said biasing element to said storage element to urge said flexible linkage to said stowed state.

12. A display unit according to claim 3, further comprising a biasing element coupled to said first element, and configured to urge said first element towards said rear of said display unit.

13. A display unit according to claim 6, further comprising a biasing element coupled to said pusher unit, and configured to urge said pusher unit towards said rear of said display unit.

14. A merchandise display system, comprising:

a shelving array comprising a plurality of shelves;

at least one display unit according to claim 3, located on at least one of said plurality of shelves.

15. A system according to claim 14, wherein said support surface comprises a shelf surface.

16. A system according to claim 14, wherein the system comprises a plurality of said display units, and the system further comprises a connecting element connected to the actuation member of each display unit of said plurality of display units.

* * * * *